US006313388B1

(12) United States Patent
Suzuki

(10) Patent No.: US 6,313,388 B1
(45) Date of Patent: Nov. 6, 2001

(54) DEVICE FOR ADDING FLUCTUATION AND METHOD FOR ADDING FLUCTUATION TO AN ELECTRONIC SOUND APPARATUS

(75) Inventor: Takashi Suzuki, Hamamatsu (JP)

(73) Assignee: Kawai Musical Insruments Mfg. Co., Ltd., Shizuoka-ken (JP)

( * ) Notice: Subject to any disclaimer, the term of this patent is extended or adjusted under 35 U.S.C. 154(b) by 0 days.

(21) Appl. No.: 09/472,174

(22) Filed: Dec. 27, 1999

(30) Foreign Application Priority Data

Dec. 25, 1998 (JP) ..... 10-369954

(51) Int. Cl.[7] ..... G10H 1/06; G10H 7/00

(52) U.S. Cl. ..... 84/622; 84/626; 84/659; 84/662

(58) Field of Search ..... 84/600–608, 622–631, 84/634, 659–663, 666, DIG. 9

(56) References Cited

U.S. PATENT DOCUMENTS 5,208,415 * 5/1993 Sato ..... 84/629
5,464,947 * 11/1995 Kitamura ..... 84/624
5,665,931 * 9/1997 Washiyama ..... 84/623
5,998,723 12/1999 Suzuki .

FOREIGN PATENT DOCUMENTS 6259067 9/1994 (JP) .

* cited by examiner

*Primary Examiner*—Marlon T. Fletcher

(57) ABSTRACT

A plurality of different fluctuation data are added to a plurality of sound signals, and the plurality of sound signals are synthesized to form a tone. Thus, different fluctuations are added to the sound signals or to part sounds of the sound signals, enabling the fluctuation to be controlled for each of the components of the tone.

37 Claims, 17 Drawing Sheets

FIG. 9

| KEY NO. K N | A0 ~ A3 | | | A4 ~ B4 | | | B5 ~ C8 | | | ••• |
|---|---|---|---|---|---|---|---|---|---|---|
| TOUCH VELOCITY T C | 0 ~ 29 | 30 ~ 80 | 81 ~ 127 | 0 ~ 31 | 32 ~ 96 | 97 ~ 127 | 0 ~ 35 | 36 ~ 100 | 101 ~ 127 | ••• ••• |
| NO. OF SELECTED FLUC. DATA (COMBINATION OF PLURAL DATA) | 1<br>2<br>3<br>4 | 1<br>2<br>3<br>5 | 1<br>2<br>3<br>6 | 1<br>3<br>4<br>5 | 1<br>3<br>4<br>6 | 1<br>3<br>5<br>6 | 1<br>4<br>5<br>6 | 1<br>4<br>5<br>7 | 1<br>4<br>6<br>7 | •••<br>•••<br>•••<br>••• |
| WEIGHING DATA WT | 1/4<br>1/4<br>1/4<br>1/4 | 1/8<br>3/8<br>1/8<br>3/8 | 3/8<br>1/8<br>3/8<br>1/8 | 1/3<br>0<br>1/3<br>1/3 | 1/3<br>1/3<br>0<br>1/3 | 1/3<br>1/3<br>1/3<br>0 | 1/8<br>2/8<br>2/8<br>3/8 | 2/8<br>2/8<br>2/8<br>2/8 | 3/8<br>2/8<br>2/8<br>1/8 | •••<br>•••<br>•••<br>••• |
| READING SPEED R S | 0.8 | 0.9 | 1.0 | 0.8 | 0.9 | 1.0 | 0.8 | 0.9 | 1.0 | ••• |

DEVICE FOR ADDING FLUCTUATION AND METHOD FOR ADDING FLUCTUATION TO AN ELECTRONIC SOUND APPARATUS

BACKGROUND OF THE INVENTION

1. Field of the Invention

The present invention relates to a device for adding fluctuation (wavering, swing or sway) to an electronic sound apparatus and to a method thereof. More particularly, the invention relates to a device for imparting fluctuation to a tone that is generated and to a method thereof.

2. Prior Art

Examples of such a device for adding fluctuation has been disclosed in Japanese Patent Application No. 346063/1992 entitled "Device for generating fluctuation waves in an electronic sound apparatus" and Japanese Patent Application No. 043933/1993 entitled "Sound fluctuation system in an electronic sound apparatus" filed by the present applicant. In the devices disclosed in this application, fluctuation waveforms are added to the pitch and amplitude of sound that is generated, so that the pitch and amplitude undergo a fine change.

The fluctuation changes in various ways and in various modes. A tone never changes monotonously, but changes in a variety of ways depending upon the frequency components and upon the time components.

SUMMARY OF THE INVENTION

An object of the present invention is to add a plurality of generated fluctuation (wavering, swing or sway) data to a plurality of generated sound signals so that different fluctuations (waverings, swings or sways) are imparted to and synthesized for the sound signals, to thereby produce synthesized sound signal. Different fluctuations are added to the part sounds that are synthesized into a sound signal, and different fluctuations are realized for each of the part sounds. The word "fluctuation" may include the word "wavering", "swing" and "sway".

BRIEF DESCRIPTION OF THE DRAWINGS

FIG. 9 is a diagram illustrating a state of reading and synthesizing the fluctuation data SW;

DESCRIPTION OF THE PREFERRED EMBODIMENTS

Outline of the Embodiments

Figure 4:
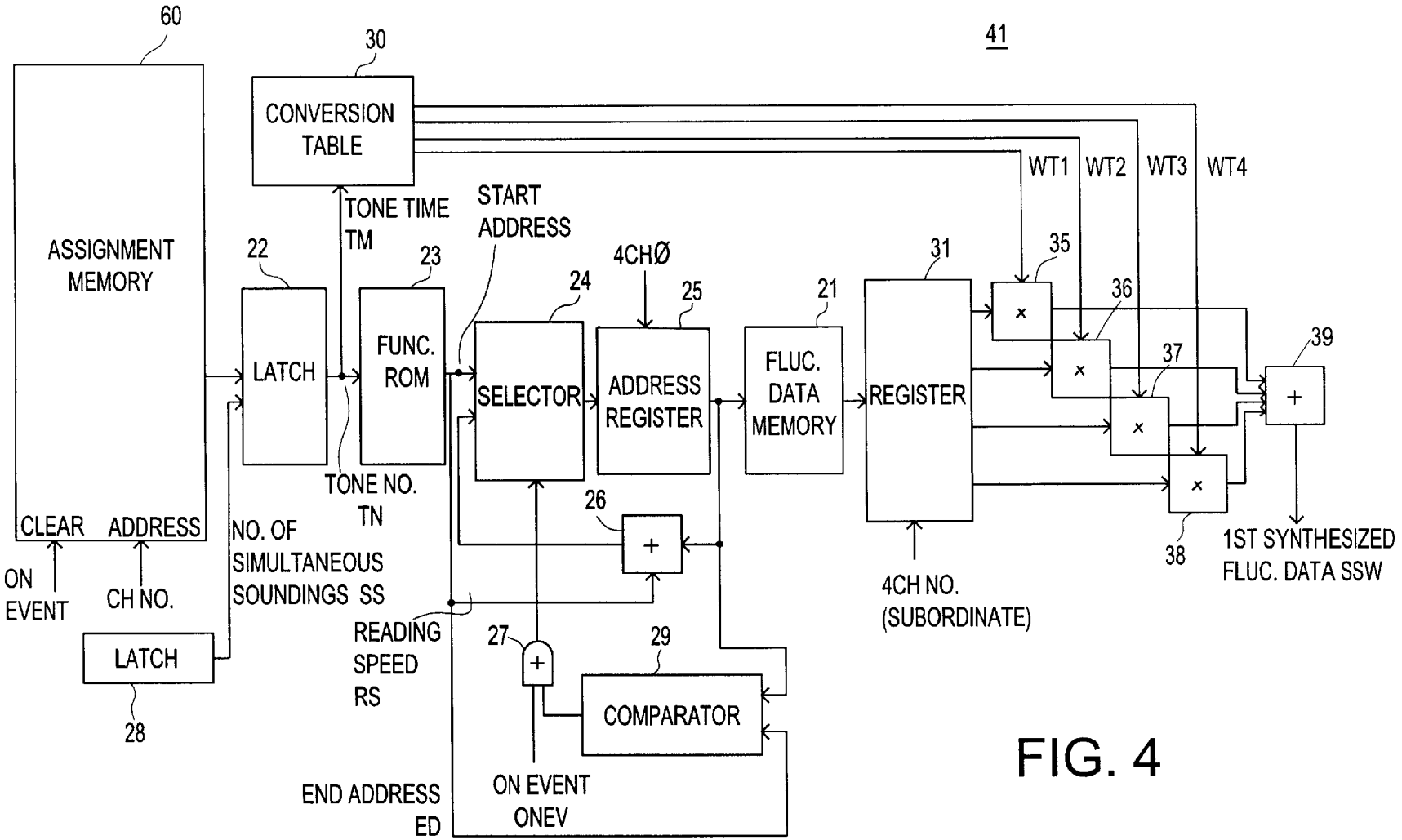
FIG. 4 is a diagram illustrating a portion of the fluctuation data generator 41.
Figure 5:
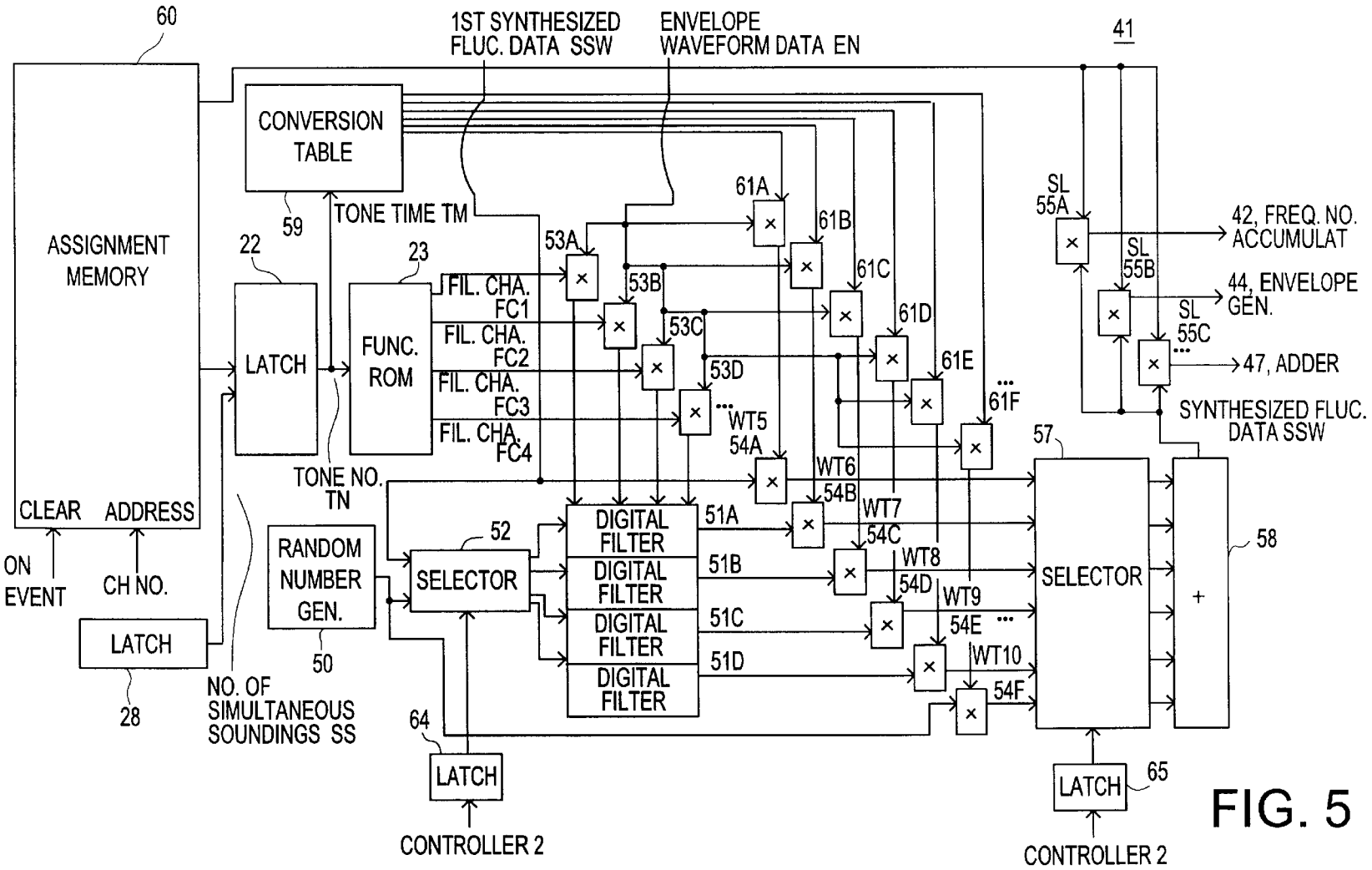
FIG. 5 is a diagram illustrating another portion of the fluctuation data generator 41.

The part sounds are assigned to the time-division channels, the fluctuation (wavering, swing or sway) data are selected for the part sounds, and the fluctuation levels are specified. As seen in FIG. 4, and based on the musical factors such as tone number data TN, the fluctuation data of the part sounds are selected by a fluctuation data memory 21 through a fluctuation ROM 23, and the fluctuation levels are controlled by multipliers 55A to 55C (shown in FIG. 5) based on the fluctuation level data SL. Further, as shown in FIG. 5 and based, on the musical factors such as tone number data TN, the filter characteristics FC1 to FC4 of fluctuation data of part sounds and input digital filters 51*a* to 51D are selected through the fluctuation ROM 23.

1. Overall Circuitry.

Figure 1:
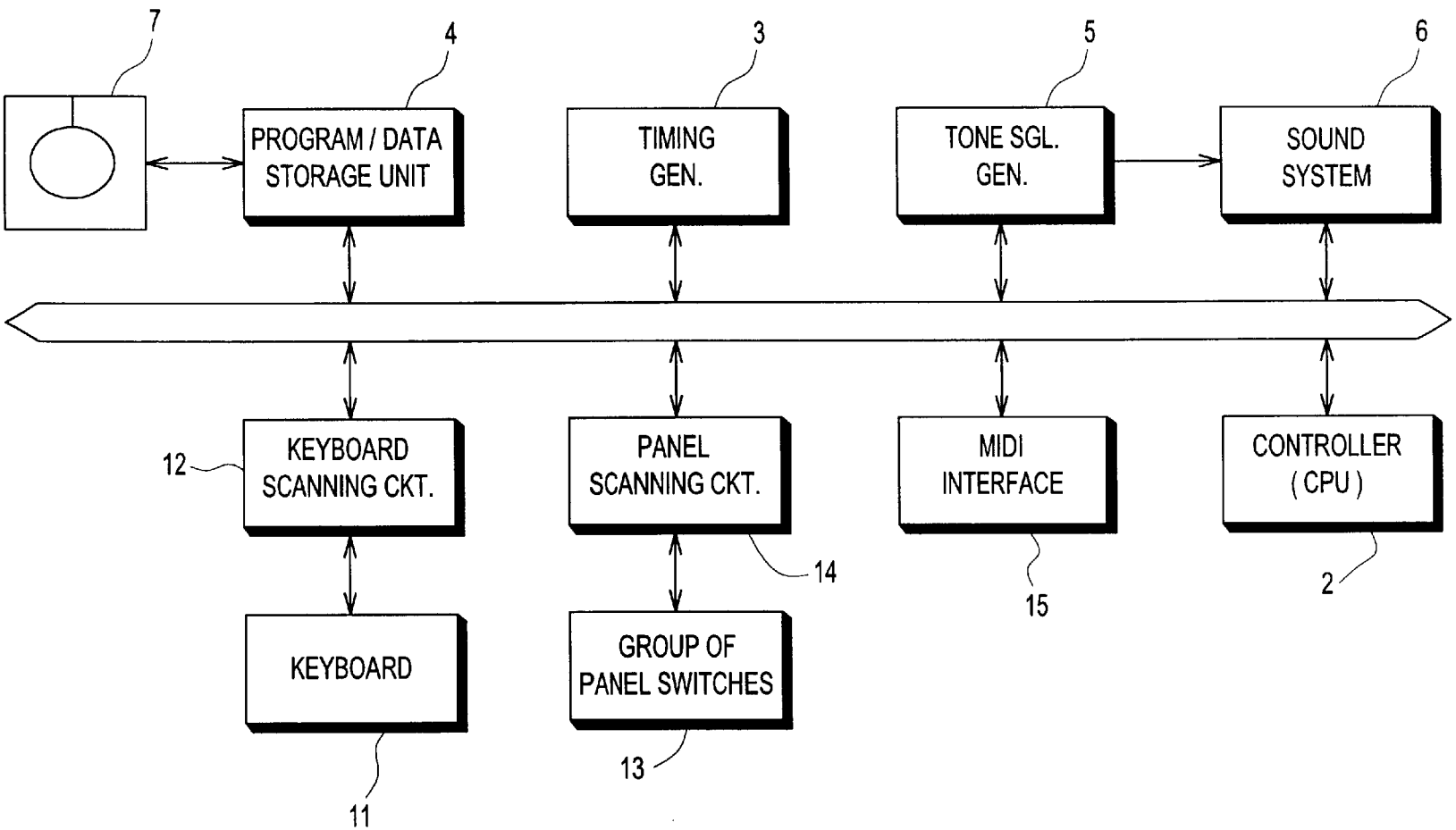
FIG. 1 is a diagram illustrating the overall circuitry of an electronic sound apparatus or an electronic musical instrument.

FIG. 1 is a diagram illustrating the overall circuitry of an electronic sound apparatus or an electronic musical instrument. The sounding start and sounding end of a tone are instructed by the keys of a keyboard 11. The keys are scanned by a key scanning circuit 12, whereby data that represents key on or key off is detected and is written by a controller 2 into a program/data storage unit 4. The data is compared with the data representing the on or off of the keys that have been stored in the program/data storage unit 4, and the on event or off event of the keys is determined by the controller 2.

Every key of the keyboard 11 is provided with a step touch switch, the scanning is effected for every step switch, and on event/off event is detected for every head on/off of every step switch. The step switch generates the touch data, i.e., an initial touch data and an after-touch data that represent the speed and strength of touch.

The keyboard 11 comprises a lower keyboard, an upper keyboard and a pedal keyboard to generate tones of different timbres, i.e., to generate tones having different envelope waveforms. Tones of two timbres can be sounded simultaneously by a key-on of the upper keyboard. The keyboard 11 may be replaced by that of an electronic string instrument, electronic wind (reed) instrument, electronic percussion (pad) or computer.

The switches in a group of panel switches 13 are scanned by a panel scanning circuit 14. Due to the scanning, the data representing on and off of the switches are detected and are written by the controller 2 into a program/data storage unit 4. The data are compared with the data representing on and off of the switches that have been stored in the program/data storage unit 4, and on event and off event of the switches are determined by the controller 2. The sounded tone is that of manual play using the keyboard 11 or that of auto play (automatic performance) reproduced from the automatic play data. The tones of manual play or automatic play are also sent from a MIDI interface 15.

A MIDI (musical digital instrument interface) 15 is provided for transmitting and receiving tone data to and from an electronic musical instrument that is externally connected. The tone data comply with the MIDI standards, and the tone is also generated based on these tone data.

The keyboard 11 or the MIDI interface 15 also includes an automatic play device. The play data (tone-generating data) generated by the keyboard 11, group of panel switches 13 and MIDI interface 15, are for generating the tones. The manual play data of the keyboard 11 are written and stored in the program/data storage unit 4 as automatic play data. Through the MIDI interface 15, the automatic play data are sent from other equipment, or the automatic play data in the program/data storage unit 4 are sent to other equipment.

The performance information data (tone-generating information (data)) are musical factor data inclusive of tone pitch (tone pitch range) data (tone-determining factor), sounding time data, field-of-performance information, number-of-sounds data and resonance degree data. The sounding time data represent the passage of time from the start of sounding a tone. The field-of-performance information represent part of play, part of tone, part of musical instrument, etc., and are corresponded to, for example, melody, accompaniment, background, chord, bass and rhythm, or are corresponded to an upper keyboard, a lower keyboard or a foot keyboard.

The pitch data are fetched as key number data KN. The key number data KN include octave data (tone pitch range data) and tone name data. The field-of-performance information are fetched as part number data PN. The part number data PN distinguish the areas of play and are set depending upon the area of play of a tone that is sounded.

The sounding time data are fetched as tone time data TM, and are based upon time count data from a key-on event or substituted by envelope phase. The sounding time data have been closely disclosed in the specification and drawings of Japanese Patent Application No. 219324/1994 as data related to the passage of time from the start of sounding.

The number-of-sounds data represent the number of tones that are concurrently sounded. For example, on/off data of an assignment memory 30 are based on the number of tone "1", which is found from flow charts of FIGS. 9 and 15 of Japanese Patent Application No. 242878/1994, FIGS. 8 and 18 of Japanese Patent application No. 276855/1994, FIGS. 9 and 20 of Japanese Patent Application No. 276857/1994, and FIGS. 9 and 21 of Japanese Patent Application No. 276858/1994.

The resonance degree data (KD) represents the degree of resonance between a tone and another tone that are simultaneously generated. The resonance degree has a large value when a ratio of integers is small between a pitch frequency of the tone and a pitch frequency of another tone, and the resonance degree has a small value when a ratio of integers is great, as can be found by the processing using a flow chart as will be described later. The resonance degree data includes a consonance degree of pitch and frequency of the tones simultaneously generated, consonance relation thereof, resonance relation of the tones simultaneously generated and resonance contents thereof.

The group of panel switches 13 are equipped with various switches inclusive of timbre tablet, effect switch, rhythm switch, pedal, wheel, lever, dial, handle and touch switch, which are for musical instruments. The pedal is loud pedal, soft pedal, damper pedal, shifting pedal, sostenuto pedal or mute pedal.

Tone control data are generated by these switches. The tone control data are musical factor data for controlling the tone that is generated, and include timbre data (timbre-determining factor), touch data (speed/strength of sounding instruction operation), number-of-sounds data, degree-of-resonance data, effect data, rhythm data, sound image (stereo) data, quantize data, modulation data, tempo data, sound volume data and envelope data.

These musical factor data, too, are synthesized with the performance information (tone data) and are input through a variety of switches, and are further synthesized with the automatic performance information or are synthesized with the performance information transmitted and received through the interface. The touch switch is provided for each of the sound instruction devices, and generates initial touch data that represent the quickness and strength of touch as well as after touch data.

The timbre data correspond to the kinds of musical instruments (sounding media/sounding means) such as a keyboard instrument (piano, etc.), a wind instrument (flute, etc.), a stringed instrument (violin, etc.) and a percussion instruments (drum, etc.), and are fetched as tone number data. The envelope data include an envelope time, an envelope level, an envelope speed and an envelope phase.

Such musical factor data are sent to a controller 2 where a variety of signals that will be described later, data and parameters are changed over to determine the content of the tone. The performance information (tone-generating data) and tone control data are processed by the controller 2, a variety of data are sent to a tone signal generator 5, and a tone signal is generated. The controller 2 includes CPU, ROM and RAM.

A program/data storage unit 4 (internal storage medium/means) comprises a storage unit such as a ROM, a writable RAM, a flush memory or an EPROM, and in which can be written and stored (installed/transferred) a program of a computer stored in an external storage medium/means such as an optical disk or a magnetic disk. In the program/data storage unit 4 are further stored (installed/transferred) programs transmitted from an external electronic musical instrument or a computer through a MIDI device or a transmitter/receiver. The program storage medium includes a communication medium.

The installation (transfer/copy) is automatically executed when the program/data data storage unit 4 is set into the tone-generating apparatus or when the power source of the tone-generating apparatus is turned on, or is installed by the operation by an operator. The above-mentioned program corresponds to a flow chart that will be described later, with which the controller 2 executes a variety of processings.

The apparatus may store, in advance, another operating system, system program (OS) and other programs, and the above-mentioned program may be executed together with these OS and other programs. When installed in the apparatus (computer body) and is executed, the above-mentioned program executes the processings and functions described in the claims by itself or together with other programs.

Moreover, part or whole of the program may be stored in, and executed by, one or more apparatuses other than the above-mentioned apparatus, and the data to be processed and the data/program that have been processed already may be exchanged among the above-mentioned apparatus and other apparatuses through communication means (Internet) in order to execute the present invention as a whole by the above-mentioned apparatus and by the other apparatuses.

In the program/data storage unit 4 are stored the above-mentioned musical factor data, the above-mentioned variety of data and various other data. These variety of data include data necessary for the time-division processing as well as data to be assigned to the time-division channels.

The tone signal generator 5 repetitively generates a tone waveform signal MW for every part sound, and a sound system 6 generates sound and outputs. The rate for repetitively generating the tone waveform signals MW varies depending upon the tone pitch data. Further, the waveform of the repetitively generated tone waveform signals Mw is changed over depending upon the musical factor data such as the timbre data mentioned above. Relying upon the time-division processing, the tone generator 5 simultaneously forms a plurality of tone signals to generate a polyphonic sound.

The timing generator 3 outputs timing control signals to every circuit so that the whole circuitry of the reverberating/resonating apparatus, tone-generating/controlling apparatus or an electronic musical instrument is maintained in synchronism. The timing control signals include clock signals of all periods, as well as a signal of a logical product or a logical sum of these clock signals, a signal of a period of a channel-dividing time of the time-division processing, channel number data CHNo and time count data TI. The time count data TI represents the absolute time, i.e., the passage of the time. The period from a reset due to the overflow of the time count data TI until a reset due to the next overflow is set to be longer than the longest sounding time among various tones and is set, depending upon the cases, to be several times as great.

2. Tone Signal Generator 5.

Figure 2:
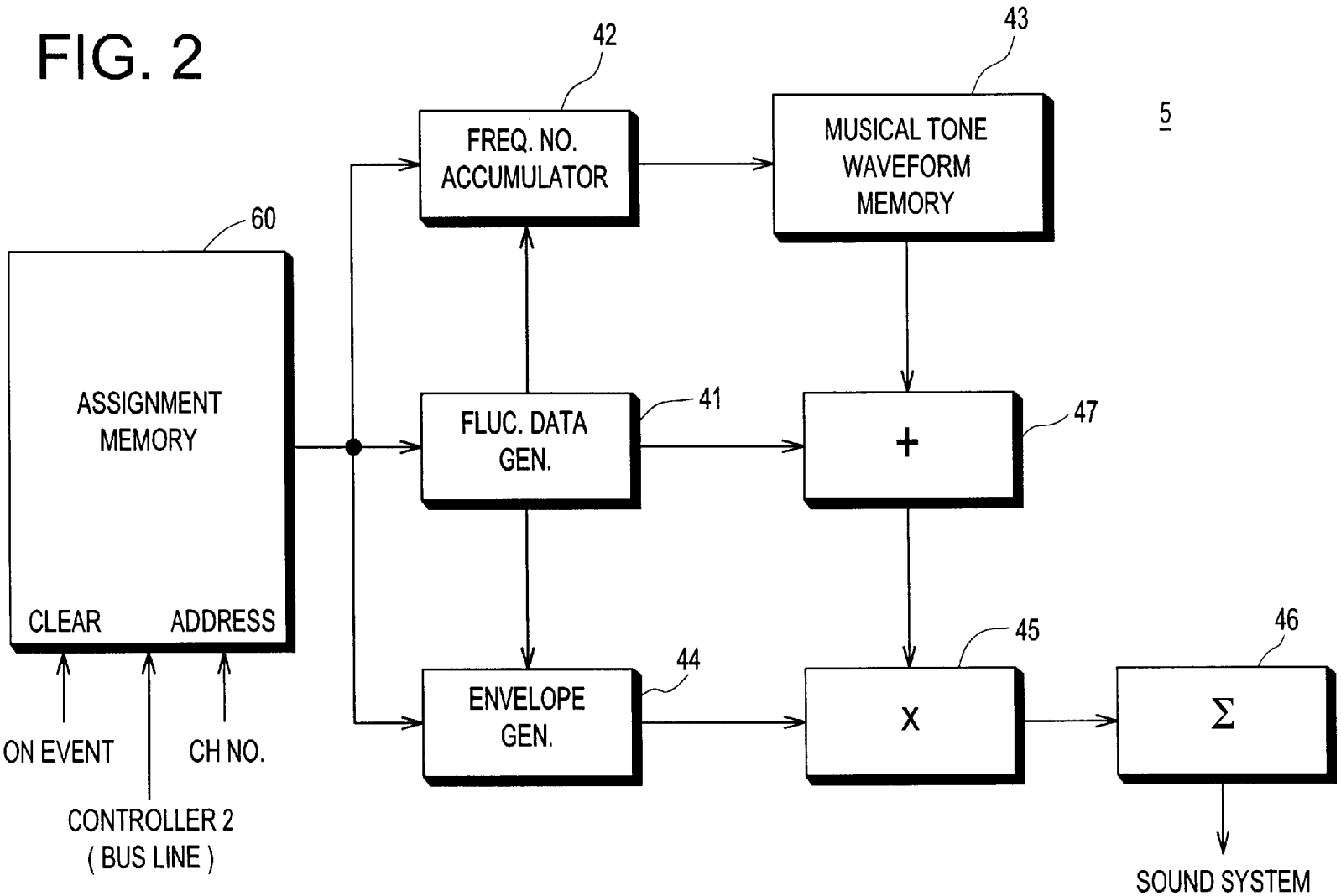
FIG. 2 is a diagram illustrating a tone generator 5.

FIG. 2 illustrates the tone signal generator 5. Musical factors such as tone number data TN of the channels read out from the assignment memory 60 are sent to a fluctuation data generator 41 which generates a synthesized fluctuation data SSW depending on these musical factors.

Musical factors such as key number data KN and tone number data TN of the channels read out from the assignment memory 60, are sent to a frequency number accumulator 42 which accumulates the frequency number data FN corresponding to the key number data KN in a time-dividing manner. The accumulated frequency number data FNA are fed to a musical tone waveform memory 43 as read-out address data in a time-dividing manner. The frequency number accumulator 42 calculates and synthesizes (adds) the synthesized fluctuation data SSW to the frequency number data FN in a time-dividing manner.

Therefore, the frequency number data FN does not remain constant but fluctuates depending upon the synthesized fluctuation data SSW, and the frequency is modulated depending on the synthesized fluctuation data SSW. The musical tone waveform data MW changes maintaining a constant (predetermined) period and, hence, a predetermined-period waveform fluctuates due to the above fluctuation.

The musical tone waveform memory 43 stores a plurality of musical tone waveform data MW which are read out based on the accumulated frequency number data FNA in a dime-dividing manner. The musical tone waveform data MW are selected based on the musical factors such as the tone number data TN or based on the selection operation by the operator using the group of panel switches 13. The musical factor such as tone number data TN are read out from the assignment memory 60, sent to the frequency number accumulator 42, converted into bank data BK, and are fed as high-order read-out address data to the musical tone waveform memory 43. The low-order read-out address data are the above-mentioned accumulated frequency number data FNA.

The musical tone waveform data MW are sampling data having a waveform of an instrument sound such as of piano, violin, flute, cymbals, etc. The musical tone waveform data MW may vary depending upon the waveforms such as sine wave, saw-tooth wave or rectangular wave, depending upon the content ratios of specific components such as harmonic components or noise components, depending upon the groups of spectral components based on specific formants, depending upon the kinds of whole waveforms from the sounding start to the sounding end, or depending upon the touch data TC and/or key scaling data KS.

The musical tone waveform data MW of simple shapes such as of sine waves, saw-tooth waves and rectangular waves can also be generated by a high-speed operation processing. Even complex waveforms can be generated by the high-speed operation processing as a matter of course.

The synthesized fluctuation data SSW are calculated and synthesized (added) through an adder 47 to the musical tone waveform data MW that are read out to vary the amplitude thereof. Therefore, the waveform that repeats maintaining a predetermined amplitude fluctuates though the musical tone waveform data MW varies maintaining a predetermined amplitude waveform. The repeating waveform, in many cases, gradually changes with the passage of the sounding time.

Musical factors such as the tone number data TN of the channels read out from the assignment memory 60 are sent to an envelope generator 44 which generates the envelope waveform data EN depending upon the tone number data TN, etc. in a time-dividing manner. The envelope waveform data EN are multiplied by the musical tone waveform data MW read out from the musical tone waveform memory 43 through a multiplier 45, and are accumulated over the whole channels through an accumulator 46 and are sent to the sound system 6 to be sounded and output (that produces sound)

The synthesized fluctuation data SSW are calculated and synthesized (added) to the envelope waveform data EN to effect the amplitude modulation. The envelope waveform data EN are multiplied and synthesized on the musical tone waveform data MW. As a result, the synthesized fluctuation data SSW are synthesized on the amplitude of the musical tone waveform data MW. The musical tone waveform data MW changes maintaining a predetermined amplitude and waveform, and the waveform that is repeating maintaining a predetermined amplitude fluctuates due to this fluctuation. The repeating waveform, in many cases, gradually changes with the passage of the sounding time.

3. Assignment Memory 60.

Figure 3:
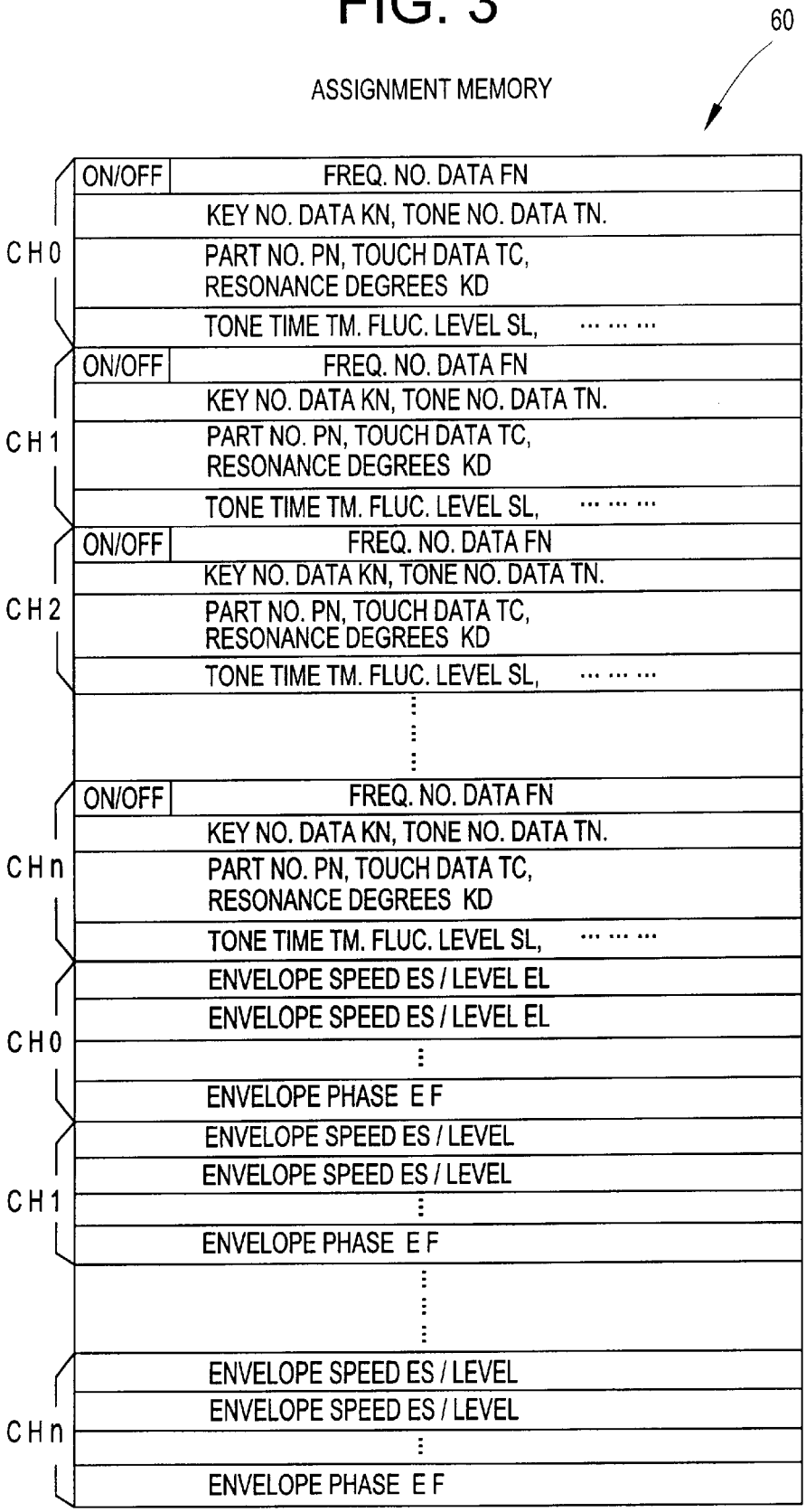
FIG. 3 is a diagram illustrating an assignment memory 60 in the tone generator 5.

FIG. 3 is a diagram illustrating an assignment memory 60 in the tone signal generator 5. The assignment memory 60 includes a plurality of (16, 32, 64, etc.) channel memory areas for storing data related to the part sounds assigned to a plurality of tone-forming channels formed in the tone signal generator 5.

A plurality of, for example, four channels are assigned to a sounding instruction (key on), and the tone (part sounds) assigned to the four channels is synthesized and is output as a tone. In this case, the on/off data of the four channels constituting a tone are simultaneously changed over to on (1) or off (0).

The channel memory areas store frequency number data FN, key number data KN and envelope data of part sounds to which the channels are assigned. Tone number data TN, touch data TC, tone time data TM, part number data PN, resonance degree data KD, on/off data and fluctuation level data SL are stored, too.

Therefore, the four part sounds constituting a tone, respectively, possesses frequency number data FN, key number data KN, envelope data, tone number data TN, touch data TC, tone time data TM, part number data PN, resonance degree data KD, on/off data, and fluctuation level data SL. Therefore, each tone has these tone number data TN and the like data in a number of four, respectively.

The on/off data indicates whether the tone (part sound) that is assigned to be sounded, is being keyed on or sounded on (1), or being keyed off or sounded off (0). The frequency number data FN represents the frequency of the part sound that is assigned and sounded on, and is converted from the key number data KN that is multiplied by the key number ratio data KR. The program/data storage unit 4 is provided with a table (decoder) for the conversion.

The envelope data comprises an envelope speed data ES and an envelope level data EL for each of the envelope phases. The envelope speed data ES represents a step value of operation per a period of digital operation of the envelope. The envelope level data EL represents a target value to be reached by the operation of the envelope for each of the phases. A counted value from a phase counter 50 that will be described later is stored as an envelope phase data EF in the assignment memory 60. The envelope data are read out from the program/data storage unit 4 based on the musical factors such as tone number data TN or based on the selection operation by an operator using the group of panel switches 13.

The key number data KN represents the pitch (frequency) of a tone that is assigned and sounded on, and is determined by the pitch data. The key number data KN is stored for all part sounds that constitute a tone. The key number data KN is additionally stored in the corresponding channel memory area of the assignment memory 60 every time when there is an on event, and the part sounds are assigned to the channels and are synthesized. The corresponding key number data KN is erased every time when there is an off event. The high-order data in the key number data KN represents a tone pitch range or octave, and the low-order data represents the tone name.

The tone number data TN represents the timbre of tone that is assigned and sounded on, and is determined depending on the timbre data. When the tone number data TN differs, the timbre differs and the tone waveform of the tone differs, too. The touch data TC represents the speed or strength of the sounding operation, and is determined depending on the touch data. The part number data PN represents the play area as described above, and is set depending on which play area the tone that is sounded is from. The tone time data TM represents the passage of time from the key on event.

The fluctuation level data SL represents the magnitude of fluctuation of the tone of the channels, i.e., of the part sounds. The fluctuation level data SL is multiplied on the synthesized fluctuation data SSW that will be described later to control the magnitude of fluctuation data of the part sounds. The fluctuation level data SL are read out based on the musical factors such as tone number data TN of a tone from a part sound table 10 that will be described later, or are input by the operator by using the group of panel switches 13. The fluctuation level data SL may be added to the synthesized fluctuation data SSW or may be subjected to any other operation.

The data of the channel memory areas are written at an on timing and/or an off timing, are rewritten or read out at every channel timing, and are processed (treated) by the tone signal generator 5. The assignment memory 60 may be provided in the program/data storage unit 4 or in the controller 2 instead of in the tone signal generator 5.

The method for assigning the tones to the channels formed by the time-dividing process (treatment), i.e., to a plurality of tone-generating systems for generating a plurality of tones (part sounds) in parallel, or a truncating method, may be any one of those disclosed in, for example, Japanese Patent Publications Nos. 42298/1989, 305818/1989, 312175/1989, 208917/1990, 409577/1990 and 409578/1990.

The channel areas of the assignment memory 60 may store the head addresses of fluctuation data SW in the fluctuation data memory 21 that will be described later or the number data for directly specifying the fluctuation data SW, and these data may be sent to an address register 25 that will be described later.

4. Musical Factors of Part Sounds.

Figure 15:
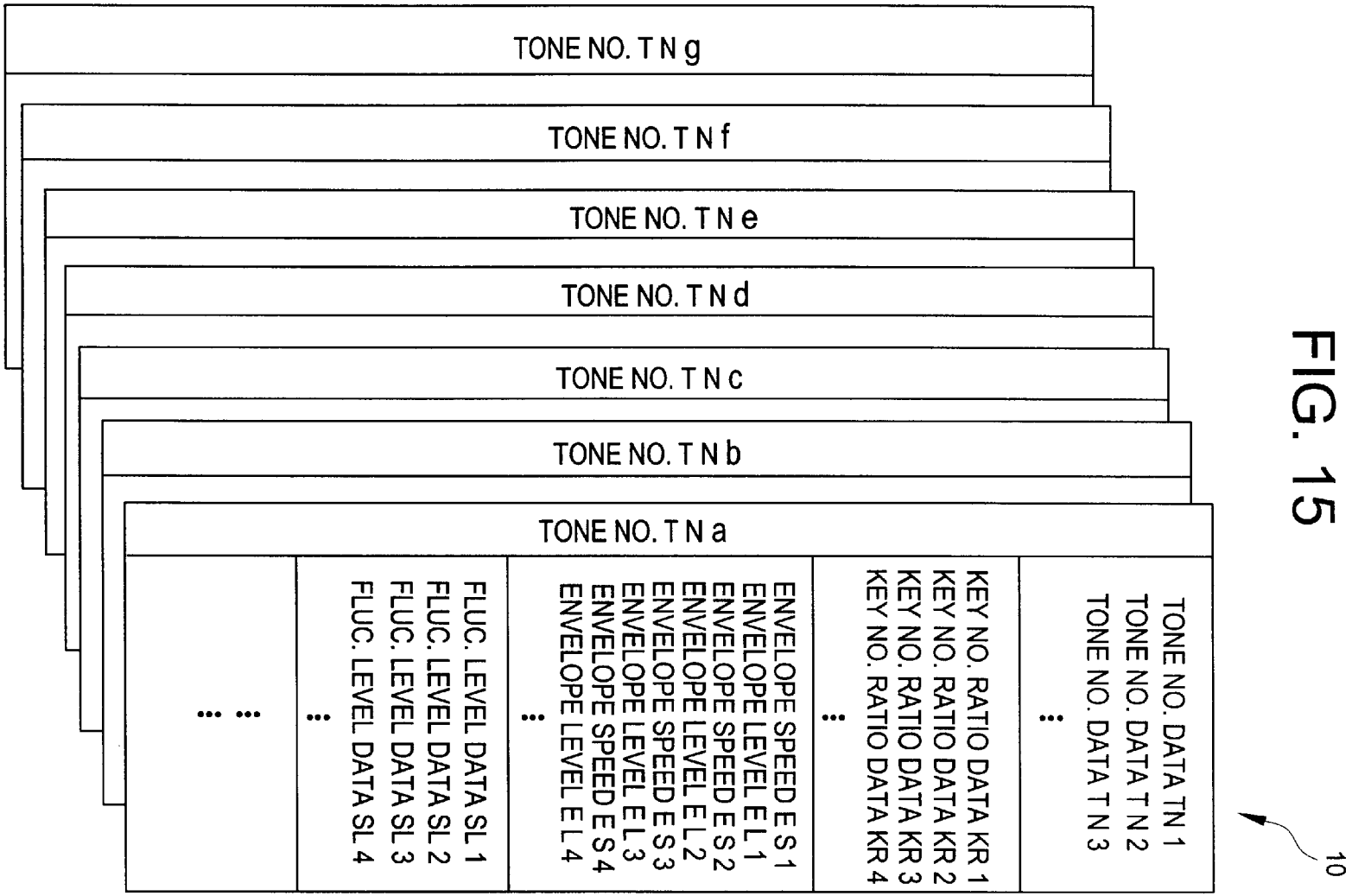
FIG. 15 is a part sound table 10 in a program/data storage unit 4.

FIG. 15 illustrates a part sound table 10 in the program/data storage unit 4. The part sound table 10 stores musical factors of the part sounds. The tone number data TN of the tone are converted into tone number data TN of part sounds in the part sound table 10. The musical waveform data MW and the fluctuation data SW are changed over and selected based on the tone number data TN of the part sounds. The tone number data TN of the part sounds are written into the channel areas of the assignment memory 60.

Figure 16:
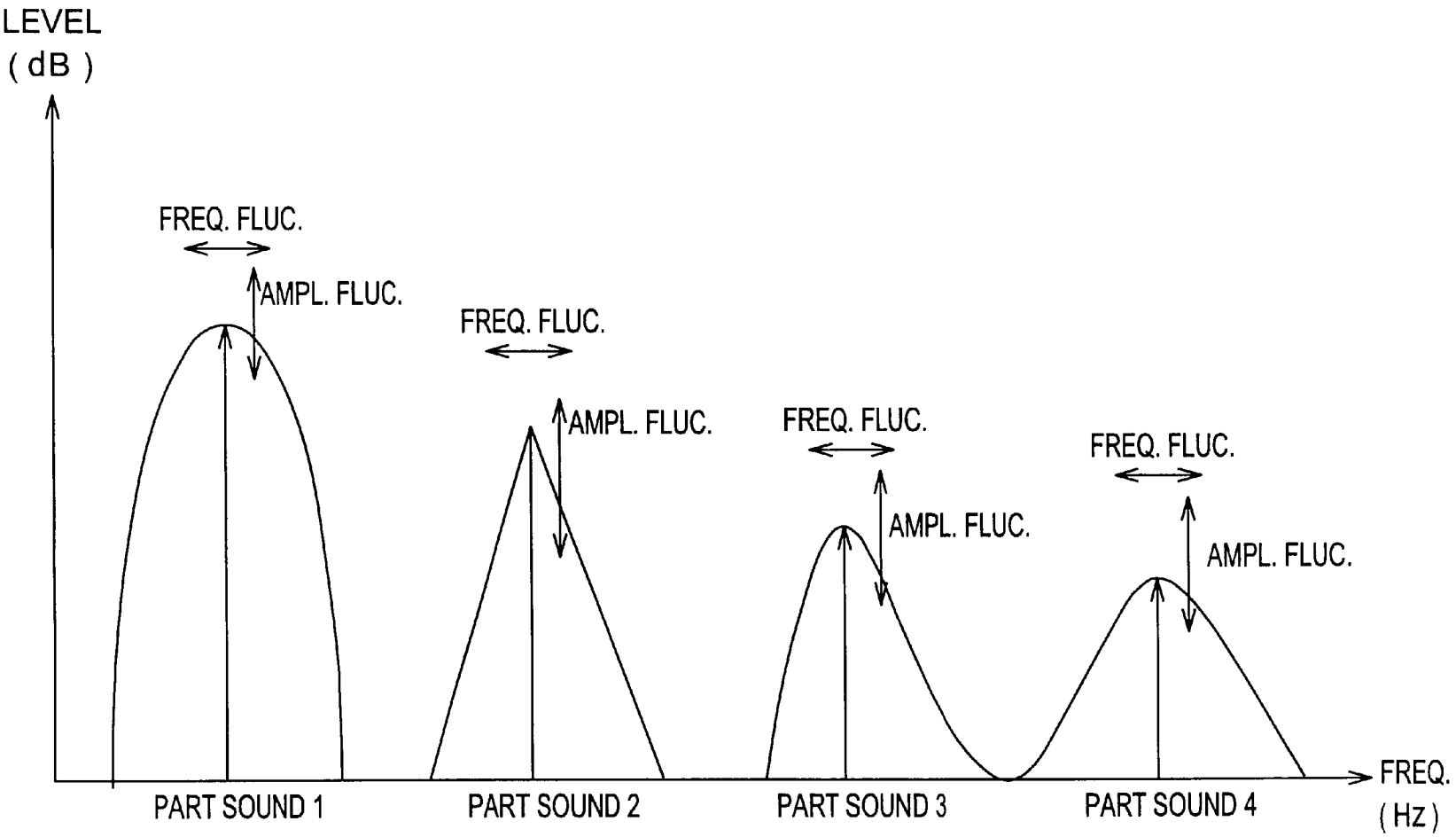
FIG. 16 is a diagram of frequency spectra of the part sounds.

The tone number data TN of the tone are converted into key number ratio data KR of the part sounds in the part sound table 10. The key number ratio data KR of the part sounds are multiplied on the key number data KN of the tone thereby to find the key number data KN of the part sounds. The key number data KN of the part sounds are written into the channel areas of the assignment memory 60. Based on the key number data KN of the part sounds, pitches of the part sounds are determined as shown in FIG. 16.

Figure 17:
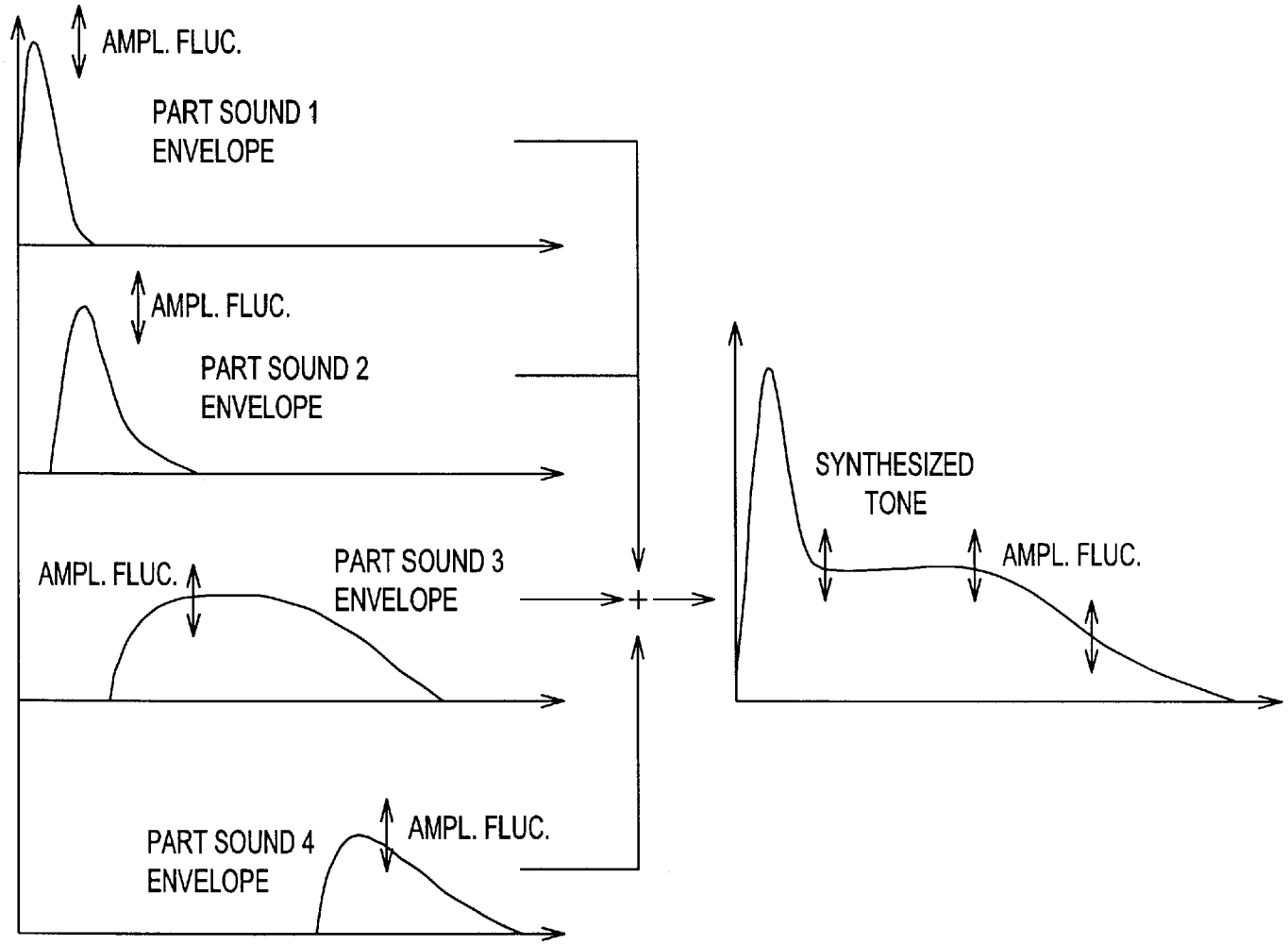
FIG. 17 is a diagram of envelope waveforms of the part sounds.

Further, the tone number data TN of the musical tones (sounds) are converted into envelope data of the part sounds in the part sound table 10. Based on the envelope data of the part sounds, envelope waveforms of the part sounds are determined as shown in FIG. 17. The envelope data of the part sounds are written into the channel areas of the assignment memory 60. The envelope data comprises an envelope speed data ES and an envelope level data EL for each of the envelope phases.

The tone number data TN of the tone are converted into fluctuation level data SL of the part sounds in the part sound table 10. The magnitude of the synthesized fluctuation data SSW, i.e., the magnitude of the fluctuation amplitude is determined based on the fluctuation level data SL of the part sounds. The fluctuation level data SL of the part sounds are written into the channel areas of the assignment memory 60.

The tone number data TN, key number ratio data KR, envelope data and fluctuation level data SL of each of the part sounds may be converted from other musical factors of the tone, instead of from the tone number data TN of the tone. Musical factors of the part sounds can be changed over and selected even by the selection operation by the operator using the group of panel switches 13.

Other musical factors of the part sounds are typically not different depending upon the part sounds. They, however, may be different. For example, the touch data TC may be different for each of the part sounds. Accordingly, the touch properties differ for each of the part sounds. Moreover, the resonance degree data KD may be different for each of the part sounds. This makes the resonance characteristics different for each of the part sounds.

5. Fluctuation Data Generator 41 (No. 1)

Figure 6:
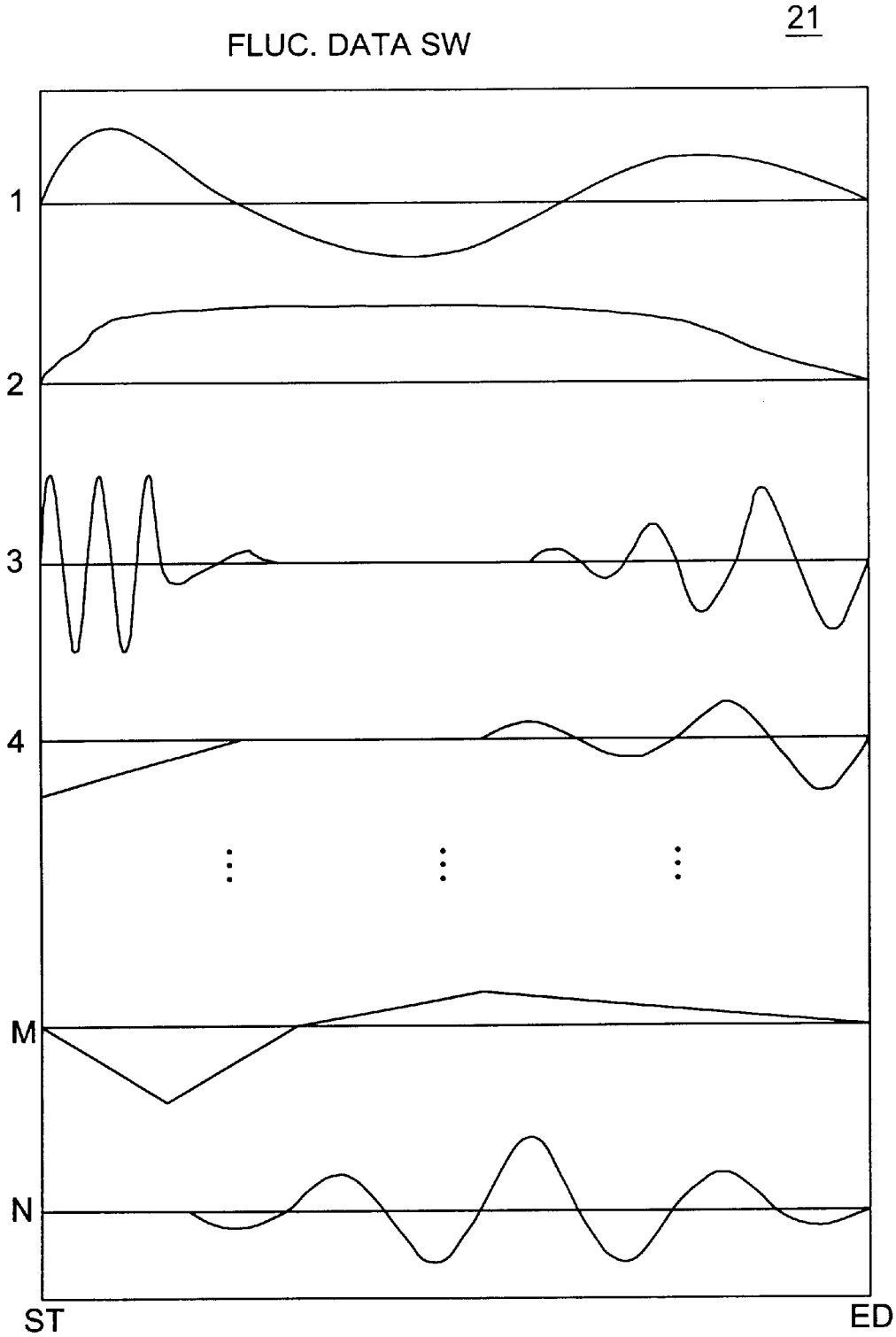
FIG. 6 is a diagram illustrating a plurality of fluctuation data SW stored in a fluctuation data memory 21.

FIG. 4 illustrates a portion of the fluctuation data generator 41. A fluctuation data memory 21 in the fluctuation data generator 41 stores a plurality of fluctuation data SW corresponding to tone number data TN, touch data TC, key number data KN, tone time data TM, number-of-simultaneous-soundings data SS, and resonance degree data KD. The fluctuation data SW of various forms are stored as shown in FIG. 6. The fluctuation data SW are amplitude data sampling various points of the fluctuation waveforms and are, often, stored in a compressed manner as disclosed in Japanese Unexamined Patent Publication (Kokai) Nos. 126292/1990, 126293/1990 and 204696/1991.

The channel areas stored in the assignment memory 60 are specified for their addresses by the channel number data CHNo. The tone number data TN, touch data TC, key number data KN, tone time data TM and resonance degree data KD of each of the channels are successively changed over and are read out. The number-of-simultaneous-soundings data SS are stored in a latch 28.

Musical factors such as tone number data TN, touch data TC, key number data KN, tone time data TM, resonance degree data KD and number-of-simultaneous-soundings data SS that are read out, are converted into start address data ST and end address data ED through a fluctuation ROM 23. The fluctuation ROM 23 stores start address data ST and end address data ED of the fluctuation data memory 21 corresponding to the data TN, TC, KN, TM, KD and SS.

The start address data ST are input to the address register 25 through a selector 24. The address register 25 stores address data of a plurality of channels which are output being gradually shifted by clock signals 4CHϕ of a frequency 4 times as high as that of the channel clock signals CHϕ. Therefore, four fluctuation data SW are read out per a tone (part sound) assigned to the channels.

Further, the lower two bits of the channel number data 4CHNo having an increment speed four times as great as described above are fed as low-order read-out address data to the fluctuation ROM 23, and the start address data ST, end address data ED and reading speed data RS are read out each in a number of four per a channel in a time-dividing manner.

When the musical factors such as tone number data TN, touch data TC, key number data KN, tone time data TM, resonance degree data KD and number-of-simultaneous-soundings data SS undergo a change, the start address data ST are changed over, causing the fluctuation data SW that are read out to be changed over. The switching data of a particular switch in the group of panel switches 13 operated by the operator is sent to the fluctuation ROM 23, and is converted into the start address data ST and the end address data ED. Therefore, the fluctuation data SW that are read out undergo a change depending on the operation by the operator.

The start address data ST that are output of address register 25 are fed to the fluctuation data memory 21 thereby to read out the fluctuation data SW. The start address data ST is added up with a reading speed data RS through an adder 26, and is fed back to the address register 25 through a selector 27 and the above-mentioned selector 24. Thus, the start address data ST is successively incremented (increased) (+1), and the fluctuation data SW are read out from the head thereof.

The reading speed data RS added through the adder 26 is selected from the fluctuation ROM 23 depending upon the tone number data TN, touch data TC, key number data KN, tone time data TM, resonance degree data KD and number-of-simultaneous-soundings data SS for each of the channels. Therefore, the speed of generating the fluctuation data SW changes depending on the musical factors. The switching data of a particular switch in the group of panel switches 13 operated by the operator is sent to the fluctuation ROM 23 and is converted into the reading speed data RS. Therefore, the reading speed data RS changes depending upon the operation by the operator.

The reading speed data RS may not be smaller than "1" or may not be larger than "1". When not larger than "1", the address data given to the fluctuation data memory 21 comprises a high-order portion of the address data from the address register 25. The on event signal ONEV is fed as a select signal to the selector 24 through an OR gate 27. At the time of a key-on, the start address data ST is input to the address register 25.

The end address data ED from the fluctuation ROM 23 is compared through a comparator 29 with a read-out address data from the address register 25. When the read-out address data becomes larger than the end address data ED, a detection signal is fed as a select signal to the selector 24 through the OR gate 27.

Therefore, the start address data ST is input again to the address register 25, the read-out address data increments (increases) again from the start address data ST, and the fluctuation data SW are repetitively read out from the start address ST to the end address ED. Though not diagramed, in this case, a difference between the read-out address data and the end address data ED is added to a new start address data ST.

The four fluctuation data SW read out from the fluctuation data memory 21 are stored in the fluctuation register 31, multiplied by weighting data WT1, WT2, WT3 and WT4 through multipliers 35, 36, 37 and 38, and are operated (added up) and synthesized through an adder 39. The fluctuation register 31 has four addresses, and is specified for its address by the low-order two bits of the channel number data 4CHNo having an increment speed 4 times as great. The four fluctuation data SW have no periodicity or have a period several times as long as that of the musical waveform data MW.

The first synthesized fluctuation data SSW is sent to the frequency number accumulator 42, envelope generator 44 and adder 47, and is sent to a digital filter 51 that will be described next. The addition and synthesis of the fluctuation data SW make it possible to prepare a countless number of fluctuation data SW of kinds larger than those stored in the fluctuation data memory 21, and to vary the fluctuation in various ways and in various modes.

The weighting data WT1, WT2, WT3 and WT4 are obtained by converting the tone time data TM read out from the assignment memory 60 by using the conversion table 30. For example, the weighting data WT1 is obtained by multiplying the tone time data TM into ⅛ times, the weighting data WT2 is obtained by multiplying the tone time data TM into ⅜ times, the weighting data WT3 is obtained by multiplying the tone time data TM into ⅛ times by subtracting the tone time data TM from the data "1", and the weighting data WT4 is obtained by multiplying the tone time data TM into ⅜ times by subtracting the tone time data TM from the data "1". The weighting ratios may be other than those mentioned above, as a matter of course. The sum of the weighting data WT1, WT2, WT3 and WT4 is "1".

Some of the weighting data WT1 to WT4 may have a value "0". This permits some fluctuation data SW to be selected depending upon the musical factors or not selected, and changes over the selection of the fluctuation data SW. When some of the weighting data WT1 to WT4 having a value "0" is changed from a given weighting data WT over to another weighting data WT, the fluctuation data selected thereby can be changed over.

The weighting data WT1, WT2, WT3 and WT4 may be read out from the fluctuation ROM 23 depending upon the tone number data TN, touch data TC, key number data KN, tone time data TM, resonance degree data KD, number-of-simultaneous-soundings data SS, and switching data of a particular switch in the group of panel switches 13 operated by the operator for each of the channels. Therefore, the ratio of synthesizing the four weighting data WT varies depending upon a change in the musical factors such as tone number data TN, touch data TC, key number data KN, tone time data TM, resonance degree data KD and number-of-simultaneous-soundings data SS, and upon a change in the switching selection by the operator.

6. Fluctuation Generator 41 (No. 2).

FIG. 5 illustrates another portion of the fluctuation data generator 41. A random number generator 50 generates random number data RN at all times. The random number data RN are used as fluctuation data SW having random values that are successively generated and in which any value appears at the same probability or the values appear at different probabilities. The random number data comprise a random number group (random noise), a normally random number group (normally random noise) an exponential random number group exponential random noise), a Poisson random number group (Poisson noise), a Gauss random number group (Gauss noise) white noise or pink noise.

The random number data RN or the first synthesized fluctuation data SSW are controlled through digital filters 51A, 51B, 51C, 51D, - - - passing through the selector 52. The filter control may be a high-pass, a low-pass or a band-pass. The first synthesized fluctuation data SSW are controlled through the digital filters 51A, 51B, 51C, 51D, - - - passing through the selector 52. The digital filters 51A, 51B, 51C, 51D, - - - permit particular frequency components of the random number data RN to be cut or pass, and cause the frequency characteristics (frequency spectrum, formant shape) to change. Depending on the cases, the digital filters 51A, 51B, 51C, 51D, - - - establish resonance at predetermined frequencies, cause the attenuation (level) of the random number data to change, and cause the cut-off frequency to change.

The selector 52 produces an output from many inputs, or produces a plurality of outputs. Upon switching the selector 52, one or a plurality of fluctuation data SW (SSW) are selected, one or a plurality of digital filters 51A, 51B, 51C, 51D, - - - are selected, and combination of the fluctuation data SW (SSW) to be synthesized are selected.

The tone number data TN, touch data TC, key number data KN, tone time data TM, resonance degree data KD of each of the channels read out from the assignment memory 60 and the number-of-simultaneous-soundings data SS from the latch 28, are also converted into filter characteristics data FC1, FC2, FC3, FC4, - - - by the fluctuation ROM 23 through the latch 22. When the musical factors such as tone number data TN, touch data TC, key number data KN, tone time data TM, resonance degree data KD and number-of-simultaneous-soundings data SS undergo a change, therefore, the filter characteristics data FC1, FC2, FC3, FC4, - - - that are read out undergo a change, too.

Further, the switching data of a particular switch in the group of panel switches 13 operated by the operator are sent to the fluctuation ROM 23, and are converted into the filter characteristics data FC1, FC2, FC3, FC4,. Therefore, the filter characteristics data FC1, FC2, FC3, FC4, - - - that are read out undergo a change depending upon the operation by the operator.

The filter characteristics data FC1, FC2, FC3, FC4, - - - are multiplied by the envelope waveform data EN that will be described later through multipliers 53A, 53B, 53C, 53D, - - - , and are fed to the digital filters 51A, 51B, 51C, 51D, - - - . Accordingly, the frequency characteristics of the fluctuation data SSW (random number data RN) change depending upon the musical factors including the envelope data, and the filter characteristics data FC1, FC2, FC3, FC4, - - - change depending upon the envelope data. A change in the filter characteristics causes a change in the above-mentioned frequency components (frequency band) characteristics and in the resonance frequency characteristics.

The filter-controlled (processed) random number data RN or the first synthesized fluctuation data SSW (random number data RN) from the digital filters 51A, 51B, 51C, 51D, - - - , the first synthesized fluctuation data SSW, and the random number data RN from the random number generator 50, are weighted by being multiplied by the weighting data WT5, WT6, WT7 and WT8 through multipliers 54A, 54B, 54C, 54D, - - - , are selected by a selector 57, and are output by being added up and synthesized through an adder 58.

The selector 57 produces an output from many inputs or produces a plurality of outputs. Upon switching the selector 57, musical components are selected to which the fluctuation is to be added. The musical components include a cycle of tone, amplitude, musical waveform, envelop, tone pitch, touch, timbre, etc.

The synthesized fluctuation data SSW are controlled for their levels by being multiplied by the fluctuation level data SL through multipliers 55A, 55B, 55C, 55D, - - - , and are sent to the frequency number accumulator 42, envelope generator 44 and adder 47. The fluctuation level data SL are stored in the channel areas of the assignment memory 60. The fluctuation level data SL of part sounds are read out in a time-dividing manner, and are sent to the multipliers 55A, 55B, 55C, 55D, Thus, the magnitudes of fluctuations of the part sounds are controlled.

As described above, the fluctuation data SW (SSW) that are generated are subjected to the filter processing through the plurality of digital filters 51A, 51B, 51C, 51D, - - - . The fluctuation data SSW subjected to the filter processing are switched and selected through the selector 52 or 57 thereby to impart fluctuation to the generated musical waveform data MW (sound signal).

The generated fluctuation data SW (SSW) are subjected to the filter processing through a plurality of digital filters 51A, 51B, 51c, 51D, - - - . The thus filter-processed fluctuation data SW (SSW) are synthesized to impart fluctuation to the generated musical waveform data MW (sound signal). Thus, by simply synthesizing various fluctuation data SW (SSW) through the filter processing, it is allowed to change the fluctuation in various ways and in various modes.

Further, upon adding and synthesizing such fluctuation data SW (SSW), it is allowed to prepare countless number of fluctuation data SW of kinds larger than those of the random number data RN and than those stored in the fluctuation data memory 21. Thus, the fluctuation can be changed in various ways and in various modes using random number data RN.

The tone time data TM and the like data read out from the assignment memory 60 are converted in the conversion table 59, and form the above-mentioned weighting data WT5, WT6, WT7, WT8, - - - . For example, the tone time data TM is multiplied by ⅙ times to form the weighting data WT5, the tone time data TM is multiplied by ⅔ times to form the weighting data WT6, and the tone time data TM is multiplied by ⅜ times to form the weighting data WT7. The weighting ratios may be other than those mentioned above, as a matter of course. The sum of the weighting data WT5, WT6, WT7, - - - is "1".

The weighting data WT5, - - - are multiplied by the envelope waveform data EN that will be described later through multipliers 61A, 61B, 61C, 61D, Accordingly, the weighting data WT5, - - - change depending on the musical factors inclusive of envelope data.

Some of the weighting data WT5, - - - has a value "0". Therefore, the fluctuation data SW of random numbers or the filter-controlled fluctuation data SW are selected depending upon the musical factors or are not selected, thus the selection of the fluctuation data SW is changed. Further, when some of the weighting data WT5, - - - of "0" is changed from a given weighting data WT over to another weighting data WT, the fluctuation data SW selected depending thereupon is changed over.

Depending on the cases, the weighting data WT5, - - - are read out from the fluctuation ROM 23 depending upon the musical factors such as tone number data TN, touch data TC, key number data KN, tone time data TM, resonance degree data KD and number-of-simultaneous-soundings data SS for each of the channels, and upon the switching of a particular switch operated by the operator using the group of panel switches 13. A change in the musical factors such as tone number data TN, touch data TC, key number data KN, tone time data TM, resonance degree data KD and number-of-simultaneous-soundings data SS and in the switching by the operator, therefore, causes a change in the ratio of synthesizing the fluctuation data SSW based on the weighting data WT.

All musical factors, i.e., tone number data TN, touch data TC, key number data KN, tone time data TM, resonance degree data KD and number-of-simultaneous-soundings data SS may be operated (added up) and synthesized, and the above-mentioned weighting data WT1, WT2, - - - , WT5, WT6, - - - may be selected and read out based on the synthesized data.

Thus, the ratio of synthesizing the fluctuation data SW (SSW) changes at the multipliers 35, 36, 37, 38, 54A, 54B, 54C, 54D, - - - depending on all musical factors. At the multipliers 55A, 55B, 55C, 55D, - - - , further, the ratio of distributing the synthetic fluctuation data SSW onto the musical components, i.e., onto the period or amplitudes, changes depending upon all musical factors.

The select data for the selectors 52 and 57 are fed from the controller 2 through latches 64 and 65. The select data change depending upon the musical factors such as tone number data TN, touch data TC, key number data KN, tone time data TM, resonance data KD and number-of-simultaneous-soundings data SS for each of the channels. Therefore, the select data also change depending on the musical components of the tone, i.e., depending on the period or amplitude. The select data also change depending on the switching of a particular switch operated by the operator using the group of panel switches 13. The selection of the selectors 52 and 57 is not alternative, but two inputs or all of three inputs can be selected.

Therefore, when the musical factors such as tone number data TN, touch data TC, key number data KN, tone time data TM, resonance degree data KD and. number-of-simultaneous-soundings data SS of each of the channels as well as the operation by the operator, undergo a change, then, the fluctuation data SW of random numbers or filter-controlled fluctuation data SW are selected or not selected depending upon the musical factors, thus selection of the fluctuation data SW is changed.

The digital filters 51A, 51B, 51C, 51D, - - - may be reduced into one, and a plurality of fluctuation data SW having different frequency components (characteristics) may be formed by the time-dividing treatment. In this case, a plurality of filter characteristics data FC are read out from the fluctuation ROM 23 in a time-dividing manner, and are fed to the one digital filter.

The four fluctuation data SW read out from the fluctuation data memory 21 may be sent to the frequency number accumulator 42, envelope generator 44 and adder 47 without being stored in the fluctuation register 31. Therefore, different fluctuation data SW read out from the fluctuation data memory 21 are directly added and synthesized to the part sounds. In this case, the address register 25 is successively shifted by the channel clock signal CHϕ.

In this case, the four fluctuation data SW are multiplied by the fluctuation level data SL1, SL2, SL3 and SL4 through the multipliers 35, 36, 37 and 38, and are sent to the frequency number accumulator 42, envelope generator 44 and adder 47. The fluctuation level data SL1, SL2, SL3 and SL4 are stored in the channel areas of the assignment memory 60. Here, the number of the time-dividing channels is four, which, however, may be larger than four.

The weighting data WT15, WT16, WT17, WT18, - - - may be fed to the multipliers 55A, 55B, 55C, 55D, instead of the fluctuation level data SL. The weighting data WT15, WT16, WT17, WT18, - - - are obtained by converting the tone time data TM read out from the assignment memory 60 using the conversion table 59. Therefore, the ratio of distributing the synthesized fluctuation data SSW onto the musical components, i.e., onto the periods or amplitudes, varies at the multipliers 55A, 55B, 55C, 55D, - - - depending on all musical factors.

7. Fluctuation of Part Sounds.

FIG. 16 is a diagram illustrating the fluctuation of part sounds constituting a tone. Each part sound is obtained by dividing a tone depending on the frequency component, and forms a formant. Musical waveform data MW of the part sounds have waveforms of different shapes and also have formants of different shapes. The waveforms of the part sounds may be the same, as a matter of course.

The fluctuation data SSW are synthesized for the musical waveform data MW of the part sounds, envelope waveform data EN thereof and frequency number data FN thereof. Therefore, the frequency spectra of part sounds shown in FIG. 16 (frequency components, formants) have varying magnitudes and slide toward the right or left along the frequency axis. Besides, the synthesized fluctuation data SSW added to the part sounds are different depending on the part sounds. Therefore, a change due to the fluctuation differs for each of the part sounds.

FIG. 17 is a diagram illustrating the fluctuations of part sounds constituting a tone. Each part sound is obtained by dividing a tone depending on the passage of time, and forms an independent envelope. The shapes of waveforms and levels of the envelope waveform data EN are different among the part sounds. The shapes of envelope waveforms and the some envelope levels may be the same among the part sounds, as a matter of course.

The fluctuation data SSW are synthesized for the envelope waveform data EN and the musical waveform data MW of the part sounds. Accordingly, the envelope waveforms of the part sounds have varying magnitudes in FIG. 17. Besides, the synthesized fluctuation data SSW added to the part sounds are different depending on the part sounds. Therefore, a change due to the fluctuation differs for each of the part sounds.

The part sounds of FIG. 16 and the part sounds of FIG. 17 are those of different tones. However, they may be the part sounds of the same tone. Then, the part sounds are divided on both the frequency components and on the time components.

8. Filter Characteristics Data FC1, FC2, FC3, FC4, - - - .

Figure 14:
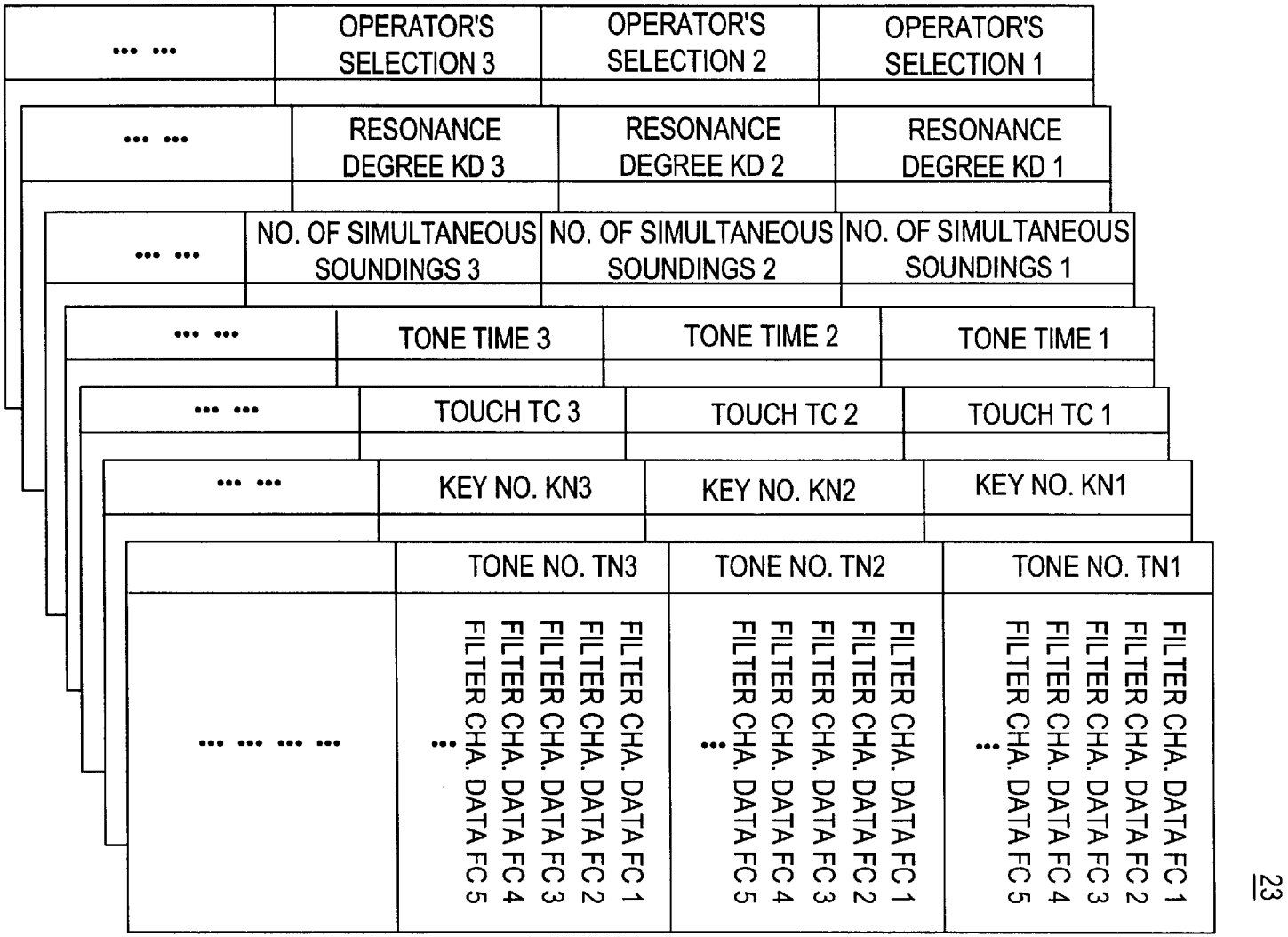
FIG. 14 is a diagram illustrating filter characteristics data FC stored in a fluctuation ROM 23.

FIG. 14 is a diagram illustrating the filter characteristics data FC1, FC2, FC3, FC4, - - - stored in the fluctuation ROM 23. A pair of filter characteristics data FC1, FC2, FC3, FC4, are read out in parallel, and are sent to the digital filters 51A, 51B, 51C, 51D, - - - .

The filter characteristics data FC1, FC2, FC3, FC4, - - - are stored in plural sets in the fluctuation ROM 23, and each set is switched and selected depending upon the musical factors such as tone number data TN, touch data TC, key number data KN, tone time data TM, resonance degree data KD and number-of-simultaneous-soundings data SS, and upon the operation by the operator.

9. Digital Filters 51A, 51B, 51C, 51D, - - - .

Figure 7:
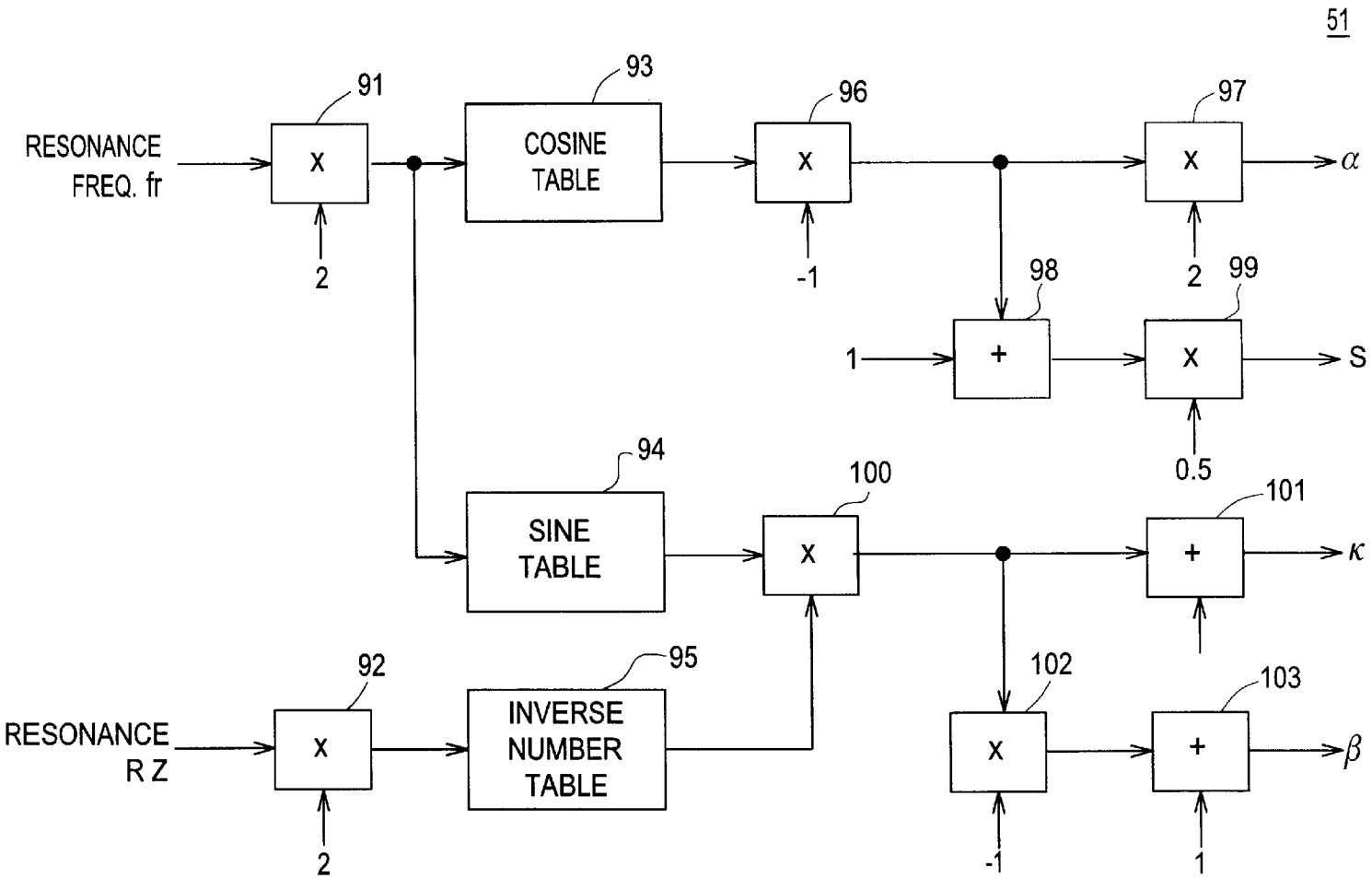
FIG. 7 is a diagram illustrating a circuit portion for calculating filter coefficients of digital filters.
Figure 8:
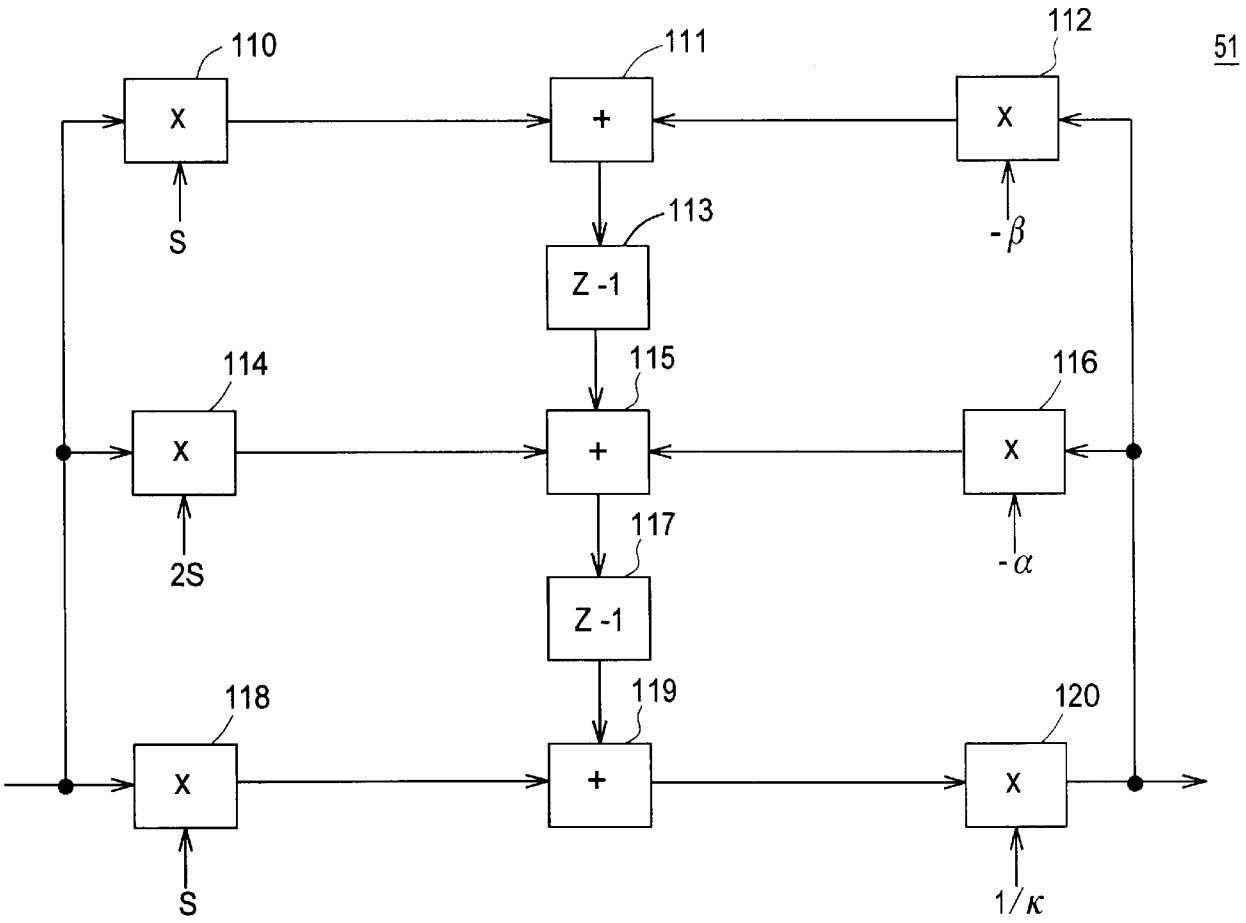
FIG. 8 is a diagram illustrating a circuit portion for calculating filter coefficients of digital filters.

FIGS. 7 and 8 are diagrams illustrating the digital filters 51A, 51B, 51C, 51D, - - - . FIG. 7 is a diagram illustrating a circuit portion for generating filter coefficients. The resonance frequency data fr among the filter characteristics data FC1, FC2, FC3, FC4, - - - is doubled through a multiplier 91, is fed to a cosine table 93 and to a sine table 94, where a cosine signal and a sine signal are read out. Further, the resonance data RZ in the filter characteristics data FC1, FC2, FC3, FC4, - - - is converted into an inverse number data 1/RZ by an inverse number table 95.

The cosine signal and the sine signal as well as the reciprocal (inverse) number data 1/RZ, are operated through multipliers 96, 97, 99, 100, 102 and adders 98, 101, 103 in FIG. 7, and where filter coefficients $\alpha$, S, $\beta$ and $\kappa$ are found.

The thus found filter coefficients $\alpha$, S, $\beta$ and $\kappa$ are fed to multipliers 110, 112, 114, 116, 118 and 120 in the IIR-type digital filters 51A, 51B, 51C, 51D, - - - in FIG. 8, and are subjected to the digital filter processing while passing through adders 11, 115, 119 and delay units 113 and 117. The digital filters 51A, 51B, 51C, 51D, - - - are those of the FIR (infinite impulse response) type. However, the digital filters 51A, 51B, 51C, 51D, - - - may be those of the FIR (infinite impulse response) type or may be those of any other type.

10. Reading and Synthesis of Fluctuation Data SW.

FIG. 9 illustrates the contents (an example) of the fluctuation data SW read out and synthesized by the fluctuation data generator 41. The fluctuation data SW to be selected are switched depending upon the musical factors shown in FIG. 9. The fluctuation data SW to be selected are denoted by numbers 1, 2, 3, 4, - - - . The weighting data WT1 to WT4 are also switched depending on the musical factors shown in FIG. 7. Further, reading speed (generation rate) of the fluctuation data SW is switched depending on the musical factors shown in FIG. 9. The reading speed data RS have the same value for the four fluctuation data of a channel, but may have different values.

In FIG. 9, the selected fluctuation data SW are switched depending on the touch data TC and the key number data KN. The selected fluctuation data SW, however, may be switched depending upon the musical factors such as tone number data TN, tone time data TM, resonance degree data KD and number-of-simultaneous-soundings data SS.

11. Envelope Generator 44.

Figure 10:
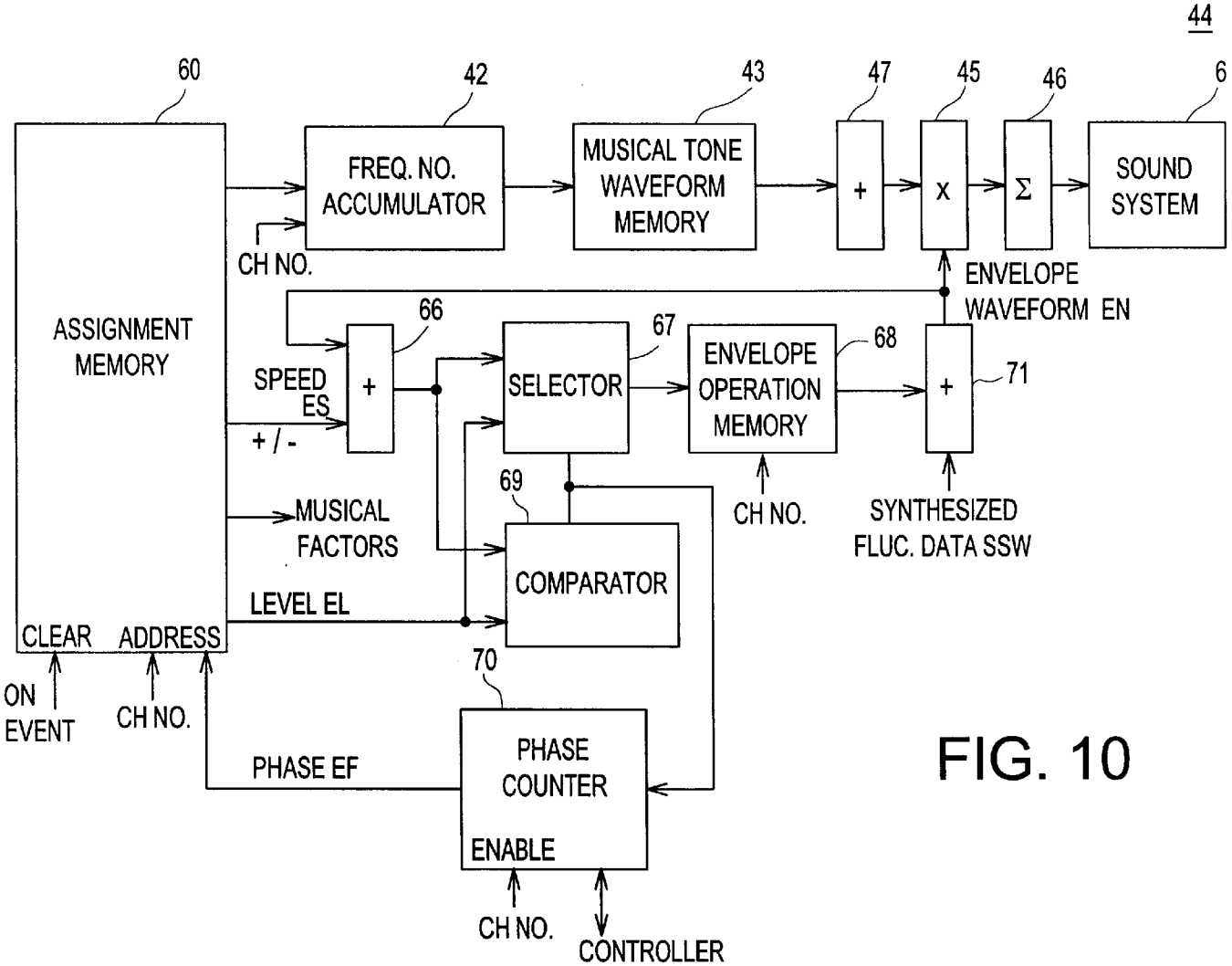
FIG. 10 is a diagram of an envelope generator 44.

FIG. 10 is a diagram illustrating the envelope generator 44. The musical factors such as frequency number data FN, tone number data TN, touch data TC, key number data KN (high-order), tone time data TM, resonance degree data KD, part number data PN, and number-of-simultaneous-soundings data SS from the latch 28 for each of the channels of the assignment memory 60 as well as the selection-specifying data by the operator, are sent to the frequency number accumulator 42. The musical waveform data MW depending upon the musical factors of these data TN, TC, KN, PN, TM, SS, KD and PN or upon the selection by the operator, are selected from a musical waveform memory 43 in a time-dividing manner.

The frequency number data FN are successively accumulated in a time-dividing manner, the high-order data of the accumulated values are sent as read-out address to the musical waveform memory 43, and the selected musical waveform data MW are read out in a time-dividing manner at a speed (pitch) corresponding to the frequency number data FN. The musical waveform data MW that are read out are multiplied by the envelope data EN in a time-dividing manner through the multiplier 45, and the musical waveform data of all channels are accumulated and synthesized through the accumulator 46 and are sounded by the sound system 6.

The envelope speed data ES of each of the channels of the assignment memory 60 are successively accumulated through an adder 66, a selector 67 and an envelope operation memory 68 in a time-dividing manner to operate the envelope operation data EN which is sent as the envelope waveform data EN to the multiplier 45 through the adder 71. The envelope operation memory 68 has areas corresponding to the number of the time-dividing channels, stores the envelope operation data EN of the channels, and operates the envelops for each of the channels.

The synthesized fluctuation data SSW are fed to the adder 71 so as to be operated (added) and synthesized for the envelope waveform data EN. Accordingly, fluctuation is added to the envelope waveform to modulate the amplitude. The envelope waveform data EN is multiplied on the musical waveform data MW. Accordingly, the synthesized fluctuation data SSW are synthesized on the amplitude of the musical waveform data MW. The musical waveform data MW changes maintaining a constant (predetermined) amplitude waveform. This fluctuation causes the repeating waveform of a constant (predetermined) amplitude to fluctuate. The repeating waveform gradually changes with the passage of the sounding time.

The envelope operation memory 68 is specified for its addresses by the channel number data CHNo, and the specified addresses only are written/read out or are reset. The channel areas of the envelope operation memory 68 are individually reset (cleared) by an on event signal.

The comparator 69 is supplied with the envelope operation data EN that is to be operated (accumulated) and the envelope level data EL of each of the channels of the assignment memory 60. When the envelope operation data EN becomes in agreement with, or exceeds, the envelope level data EL, the comparator 69 detects a phase end signal and outputs it. The phase end signal represents the end of phases of the envelopes. The phase end signal is sent to the selector 67, and the envelope operation data EN is changed over to the envelope level data EL. The envelope level data EL is a target value of the phase envelope operations.

The phase end signal is input to a phase counter 70 where a count value is increased by +1. The phase counter 70 counts the phases of envelopes of the channels. The phase counter 70 is provided with counters of a number corresponding to the number of the time-dividing channels, and only those counters specified by the channel number data CHNO are enabled so as to increase the counted value or so as to be reset. The phase counter 70 is able to be set in advance and the following envelope phase data EF is set by the controller 2.

The envelope phase data EF of the phase counter 70 are sent as address data to the assignment memory 60. The envelope speed data ES and the envelope level data EL for each phase in each channel are read out or written. The envelope phase data EF are further fed to the controller 2, and are written by the controller 2 into the assignment memory 60.

The assignment memory 60 is specified for its addresses by the channel number data CHNo, and the specified addresses only are written/read out or cleared. The channel areas of the assignment memory 60 are individually reset (cleared) by an on event signal.

12. Frequency Number Accumulator 42.

Figure 11:
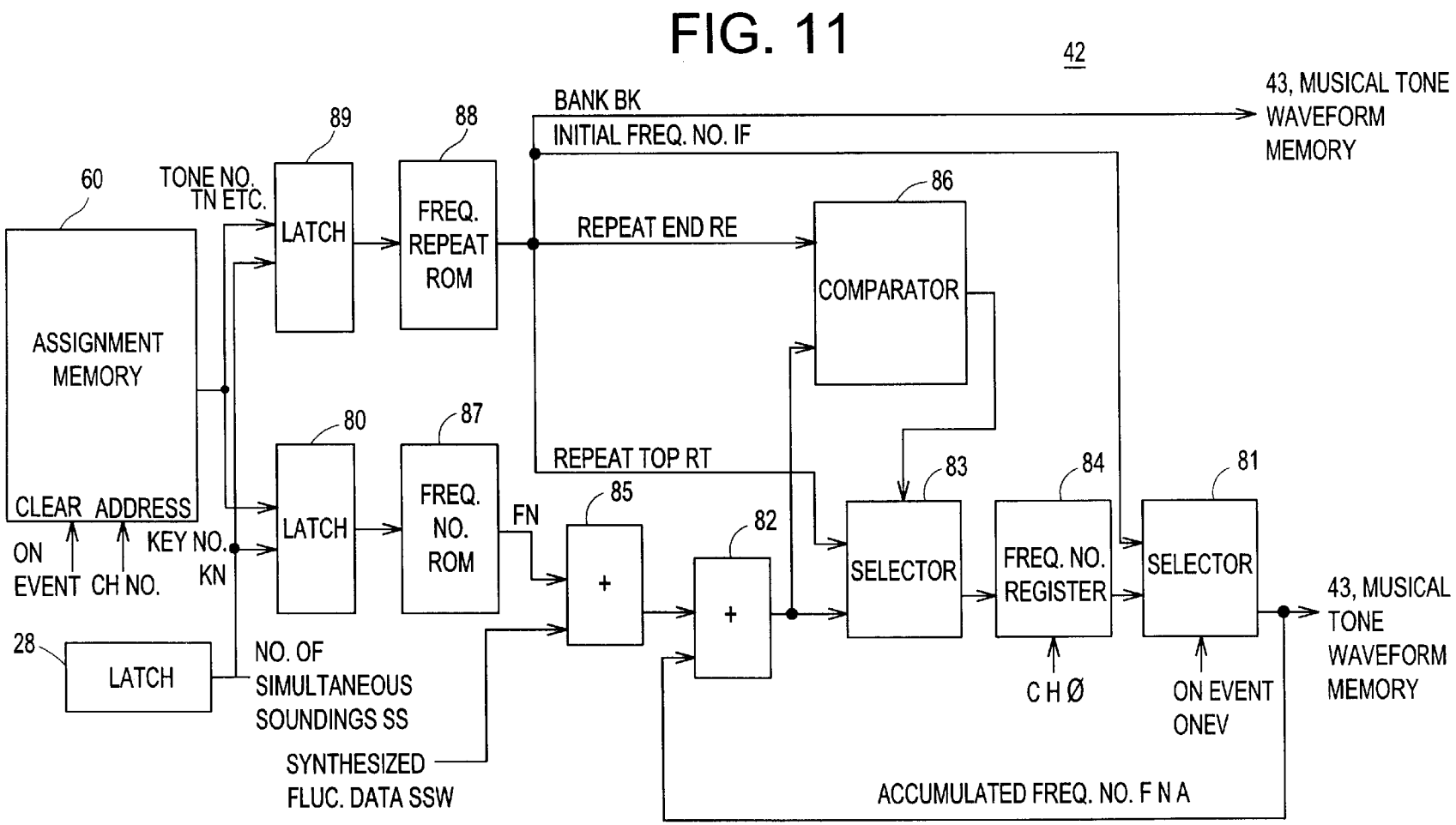
FIG. 11 is a diagram of a frequency number accumulator 42.

FIG. 11 is a diagram illustrating the frequency number accumulator 42. The key number data KN of the channels of the assignment memory 60 are converted into frequency number data FN through a frequency number ROM 87 through a latch 80.

The musical factors such as frequency number data FN, tone number data TN, touch data TC, key number data KN (high order), tone time data TM, resonance degree data KD, part number data PN and number-of-simultaneous-soundings data SS from the latch 28 of each of the channels of the assignment memory 60 and the data for specifying the selection by the operator, are converted into bank data BK, initial frequency number data IF, repeat top data RT and repeat end data RE by a frequency repeat ROM 88 through a latch 89 depending upon the data TN, TC, KN, TM, SS, KD and PN.

At the time of an on event, the initial frequency number data IF is added up with the frequency number data FN through an adder 82 via a selector 81, and is set to a frequency number register 84 through a selector 83. The frequency number register 84 stores frequency number data FN of a plurality of channels, and is successively shifted by the channel clock signals CHϕ.

Therefore, the frequency number data FN are successively accumulated with the initial frequency number data IF as an initial value for every dividing time of the 16 channels.

The frequency number data FN are added up with the synthesized fluctuation data SSW from the fluctuation data generator 41 through an adder 85, and are accumulated. Therefore, the frequency is modulated depending on the synthesized fluctuation data SSW.

Accordingly, the frequency number data FN does not assume a constant value but fluctuates depending on the synthesized fluctuation data SSW, and is modulated for its frequency depending on the synthesized fluctuation data SSW. Though the musical waveform data MW change maintaining a constant (predetermined) periodic waveform, therefore, the constant (predetermined) periodic waveform fluctuates.

The repeat end data RE is fed to a comparator 86. The comparator 86 has also been served with the accumulated frequency number data FNA from the adder 82, and sends a comparison detection signal to the selector 83 when the accumulated frequency number data FNA exceeds the repeat end data RE. Therefore, the accumulated frequency number data FNA returns from the repeat end data RE to the repeat top data RT, and is successively accumulated.

The synthesized fluctuation data SSW are added to the frequency number data FN through the adder 85, but may be added to the accumulated frequency number data FNA output from the selector 81, instead. The fluctuation data SW may have the same nature as the sent data, may be added to the key number data KN through an adder, and the synthesized key number data KN may be set to the latch 80. Further, the fluctuation data SW may be synthesized with the frequency number data FN or the key number data KN by using an operation circuit that realizes multiplication, subtraction, division or any other particular operation formula, in addition to addition.

13. Overall Processing.

Figure 12:
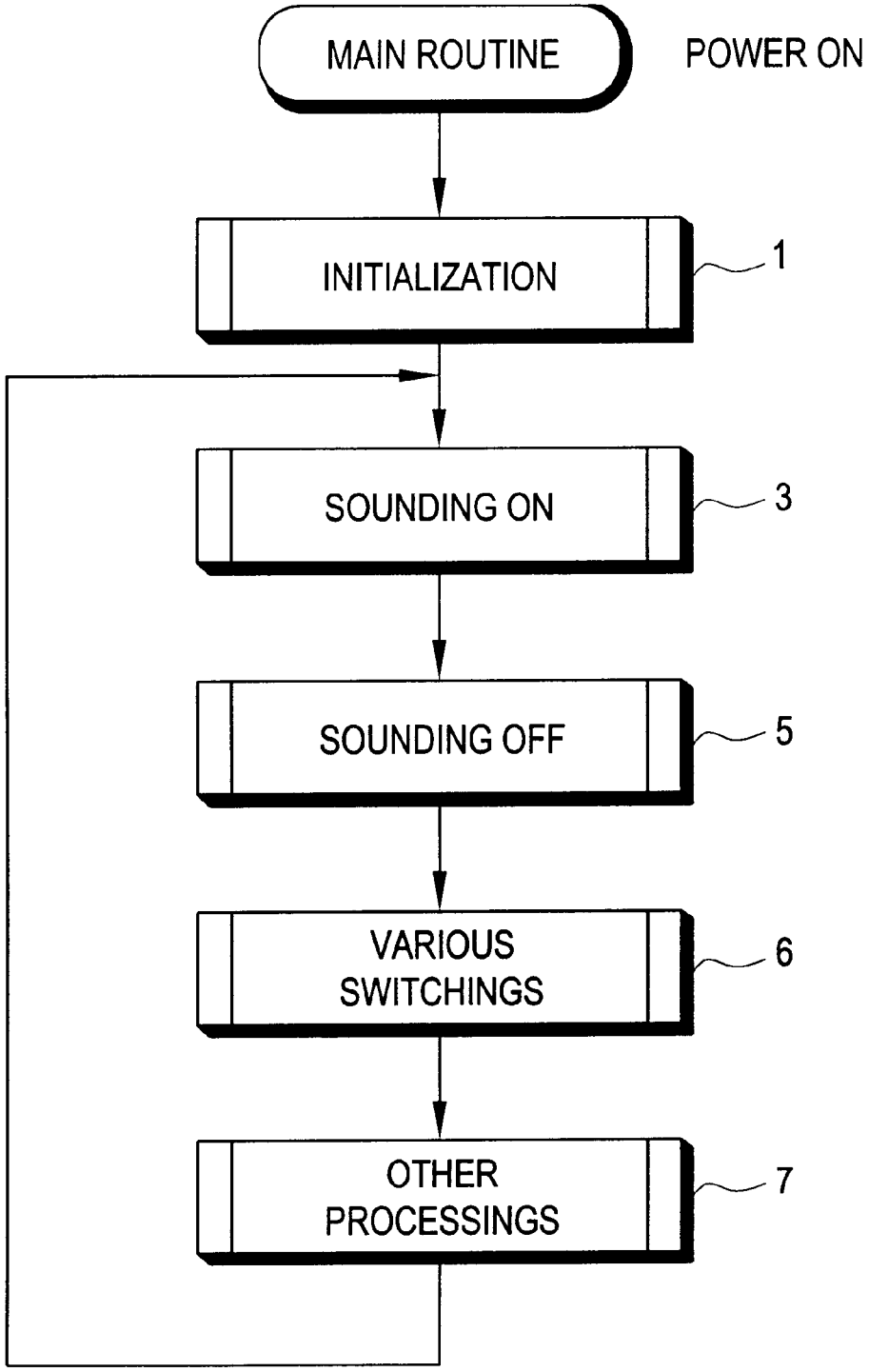
FIG. 12 is a flow chart illustrating the whole processing.

FIG. 12 is a flow chart of the overall processing executed by the controller (CPU) 2 of FIG. 1. The overall processing is started by the turn-on of the power source of the tone-generating apparatus, and is repetitively executed until the power source is turned off. First, a variety of initialization processings are executed for the program/data storage unit 4 (step 01), and a sounding start processing is executed based on the manual play or the automatic play by the performance information-generating unit (not shown in FIG. 1) (step 03).

In the sounding start processing, an empty channel is searched, and a tone related to an on event is assigned to the empty channel that is searched. The content of the tone is determined depending upon the performance information (tone-generating data) from the performance information-generating unit, musical factor data in the tone control data, and musical factor data that have been stored already in the program/data storage unit 4.

In this case, on/off data "1", frequency number data FN, envelope speed data ES, envelope time data EL, and envelope phase data EF "0" are written into the area of the assignment memory 60 of the empty channel that is searched. There are further written tone number data TN, touch data TC, part number data PN and tone time data TM "0".

Then, a sounding end (decay) processing is executed based on the manual play or the automatic play in the keyboard 11 or the group of panel switches 13 (step 05). In the sounding end (decay) processing, a channel to which a tone of an off event (key-off event, sounding end event) is assigned is searched, and the tone is decayed to end the sounding. In this case, the envelope phase of a tone related to the key-off event is released, and the envelope level gradually approaches "0".

Besides, upon operating a variety of switches of the group of panel switches 13, the musical factor data corresponding to the switches are fetched and are stored in the program/data storage unit 4, whereby the musical factor data are changed (step 06). Thereafter, other processings are executed (step 07), and the processing is repeated from the step 02 up to the step 07.

14. Elapsed Time of Sounding, Number of Simultaneous Soundings and Resonance Degree.

Figure 13:
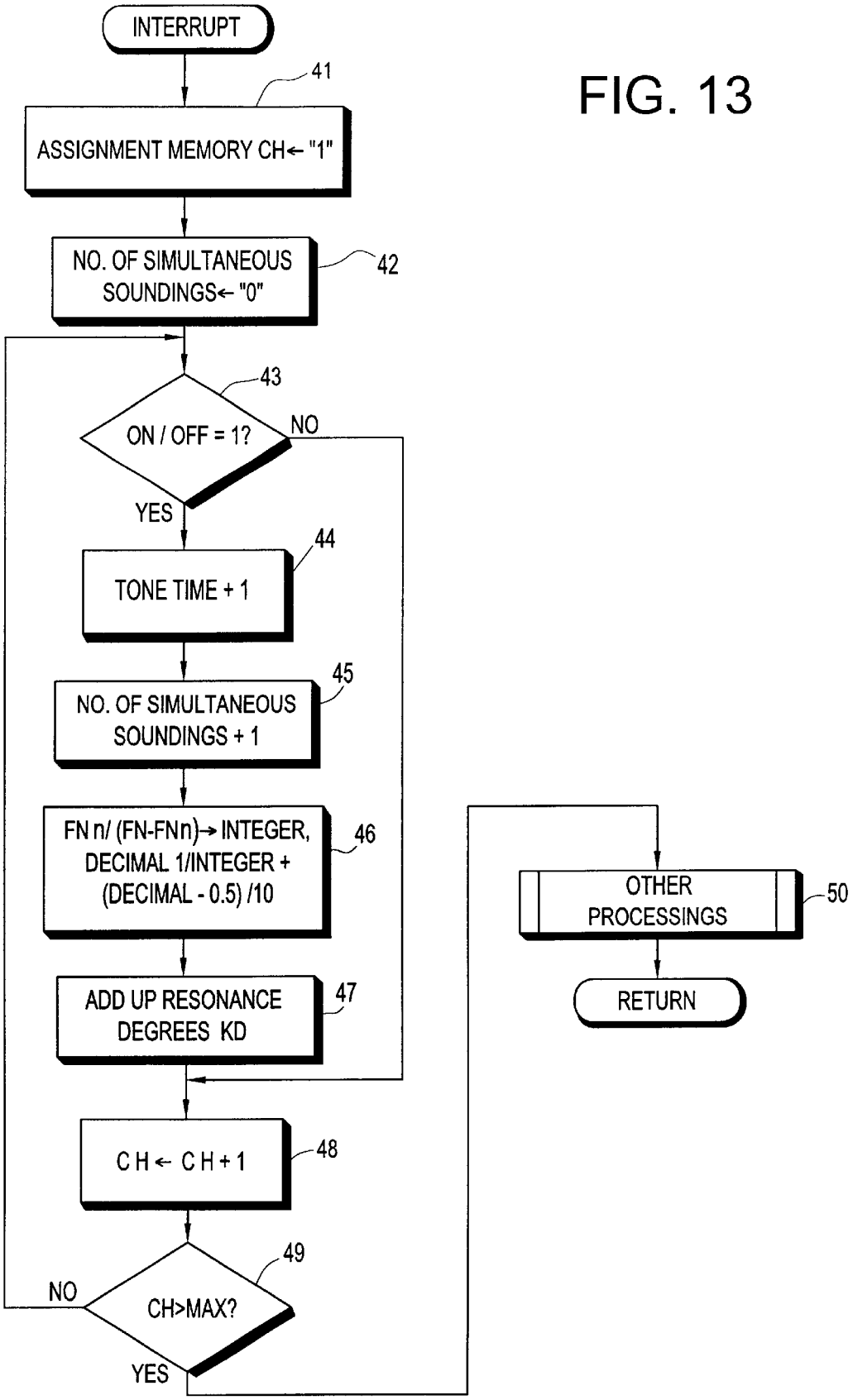
FIG. 13 is a flow chart of an interrupt processing executed after every constant (predetermined) period.

FIG. 13 is a flow chart of an interrupt processing executed by the controller 2 after every constant (predetermined) period. Through this processing, the tone time data TM (elapsed time of sounding) is increased, the number-of-simultaneous-soundings data SS are counted, and the resonance degree data are calculated.

In this processing, the tone time data TM is increased by +1 (step 44) for the data of which the on/off data is "1" and of which the tone is being sounded (step 43) for each of the channel areas (steps 41, 48, 49) of the assignment memory 60.

Similarly, after the number-of-simultaneous-soundings data SS in the latch 28 is once cleared (step 42), the data of which the on/off data is "1" and of which the tone is being sounded are counted (step 43), and the number-of-simultaneous-soundings data SS is successively increased by +1 (step 45) for each of the channel areas (steps 41, 48, 49) of the assignment memory 60. The number-of-simultaneous-soundings data SS that is counted is stored in the latch 28.

Then, a difference between the key number data KN (frequency number data FN) and the key number data KN (frequency number data FN) of another channel area that is being sound, is determined for the data where the on/off data is "1" and when the tone is being sounded (step 43) for each of the channel areas (steps 41, 48, 49) of the assignment memory 60. The key number data KN (frequency number data FN) is divided by this difference to find an inverse number of an integer part of the divided value. Further, a difference between a decimal part of the divided value and "0.5" is found, and a value which is 1/10 or 1/100 of the difference is added to the above inverse number (step 46).

The operated values are further found among other key number data KN (frequency number data FN) that are being sounded, and are accumulated (step 47) The accumulated value serves as the resonance degree data KD for the tone of the channel. The resonance degree data KD is found for all data of which the tones are being sounded (steps 41, 48, 49, 43).

Then, other periodic processings are executed (step 50). Thus, the elapsed time of sounding of the tone is counted and stored for all channels, and is utilized as the sounding time data. Additionally, the number of the tones being sounded of from all channels are frequently counted and stored, and are utilized as the number-of-simultaneous soundings data. Further, the resonance degrees of the tones being sounded of from all channels are frequently calculated and stored, and are utilized as the resonance degree data KD.

The present invention is in no way limited to the above-mentioned embodiments only but can be modified in a variety of ways without departing from the gist of the present invention. For example, the fluctuation data SW may be operated for the volume data, touch data TC, tone data TN and filter characteristics data. In this case, the fluctuation data SSW from the fluctuation data generator 41 are sent to the multiplier 45 and to the digital filter 17 and volume level controller in the sound system 6.

Further, the touch data TC of the assignment memory 60 are sent by the controller 2 to the frequency number accumulator 42, to the envelope generator 44 and to the fluctuation data generator 41 together with the tone number data TN and key number data KN. The fluctuation data SW are synthesized for the touch data TC that are sent, and are set to the latches 22 and 89.

Additionally, the plurality of fluctuation data SW stored in the fluctuation data memory 21 may be stored for a group of other musical factors that are mentioned above. Therefore, the fluctuation data SW vary for the musical factors of each group. When the fluctuation data memory 21 has a large storage capacity, the fluctuation data SW of from the sounding start to the sounding end are all stored, and need not be read out repetitively.

The plurality of fluctuation data SW may be selected by operating the switches in the group of panel switches 13, e.g., by operating a switch that selects the kind of effect. In this case, the operation data of the switch is used in place of the tone number data TN.

The musical waveform data MW are those in which a given waveform is periodically repeated. However, the musical waveform data MW may have a waveform of an attack portion that changes in a complex manner, may have a PCM waveform from the attack to the release which does not occur periodically, or may be noise that does not change periodically. Additionally, the sound signals need not have a periodic nature.

What is claimed is:

1. A device for adding fluctuation comprising:

sound data generation means for generating a plurality of part sounds of an original tone;

fluctuation data generation means for generating a plurality of fluctuation data, wherein each fluctuation data of said plurality of fluctuation data is different from each other, and wherein a plurality of fluctuation data is generated for each generated part sound;

adding means for adding the plurality of generated fluctuation data to the plurality of generated parts sounds, wherein said adding means adds a plurality of different fluctuations to each of the part sounds;

sound synthesizing means for synthesizing sounds resulting from the addition of the plurality of different fluctuations to each of the plurality of part sounds, and for outputting the synthesized sounds as a single sound that is a modification of the original tone.

2. The device according to claim 1, wherein the part sounds are simultaneously generated by a single sound instruction, and wherein each part sound has a corresponding formant, frequency spectrum, frequency component or time part.

3. The device according to claim 1, wherein the plurality of fluctuation data are selected from a larger plurality of fluctuation data, and wherein the fluctuation data are changed based on a musical category or a musical factor of the part sounds, or from selection by an operator.

4. The device according to claim 1, wherein the plurality of part sounds are selected from a larger variety of sound data, and wherein the parts sound are changed based or a musical category or a musical factor of the part sounds, or from selection by an operator.

5. The device according to claim 1, wherein each of the plurality of part sounds has a constant periodic waveform which changes periodically, but where the change is not due to the addition of fluctuation data.

6. The device according to claim 1, wherein the fluctuation data does not change periodically, or periodically changes over periods which are several times as long as periods in which the part sounds periodically change.

7. The device according to claim 1, wherein the fluctuation data is a random number that is generated from a random number generator; and wherein stored fluctuation waveform data of a stored fluctuation waveform is read out.

8. The device according to claim 1, wherein a generating speed of the fluctuation data is changed based on a musical category or a musical factor of the part sounds, or from selection by an operator.

9. The device according to claim 1, wherein the fluctuation data is generated based on being filtered through a plurality of digital filters, each filter having different filter characteristics, and wherein the filter characteristics are changed based on a musical category or a musical factor of the part sounds, or from selection by an operator.

10. The device according to claim 1, wherein the different plurality of fluctuation data is weighted, combined and synthesized, and wherein the weighted, combined and synthesized fluctuation data are changed based on a musical category or a musical factor of the part sounds, or from selection by an operator.

11. The device according to claim 1, wherein the fluctuation data is added to the period and amplitude of the generated part sounds.

12. The device according to claim 1, wherein the different plurality of fluctuation data is weighted, combined or synthesized, and wherein the combination, ratio of the weighting, or the synthesizing are changed based on a musical category or a musical factor of the part sounds, or from selection by an operator.

13. The device according to claim 1, wherein the fluctuation data is added to the period or the amplitude of the generated part sounds.

14. The device according to claim 1, wherein said fluctuation data generation means further includes a register that outputs four fluctuation data for each part sound input thereto.

15. The device according to claim 1, wherein said fluctuation data generation means further includes an assignment memory for storing said part sounds and musical factors of said parts sounds, and a conversion table for applying weighting factors to said plurality of fluctuation data, wherein said weighting factors are generated from said conversion table based on receiving at least one of said musical factors from said assignment memory.

16. The device according to claim 15, wherein said fluctuation data generation means further includes a plurality of multipliers for multiplying the generated fluctuation data by said weighting factors, wherein an output therefrom are a weighted plurality of fluctuation data that is thereafter added to said plurality of part sounds in said adding means.

17. A method of adding fluctuation comprising:

generating a plurality of part sounds of a single original tone;

generating a plurality of fluctuation data, wherein each fluctuation data of said plurality of fluctuation data is different from each other, and wherein said plurality of fluctuation data is generated for each of the plurality of generated part sounds;

adding the generated plurality of fluctuation data to each of the generated part sounds, wherein a different plurality of fluctuations are added to each of the plurality of part sounds;

synthesizing the sounds resulting from the addition of the different fluctuations to each of the part sounds; and outputting the synthesized sounds as a single sound that is a modification of said original tone.

18. The method according to claim 17, wherein the part sounds are simultaneously generated by a single sound instruction, each of the part sounds having a corresponding formant, frequency spectrum, frequency component or time part.

19. The method according to claim 17, wherein the fluctuation data is selected from a larger plurality of fluctuation data, and changed based on a musical category or musical factor of the part sounds, or from selection by an operator.

20. The method according to claim 17, wherein a generating speed of the fluctuation data is changed based on a musical category or a musical factor of the part sounds, or from selection by an operator.

21. The method according to claim 17, wherein the fluctuation data is generated based on being filtered through a plurality of digital filters, each filter having different filter characteristics, and wherein the filter characteristics are changed based on a musical category or a musical factor of the part sounds, or from selection by an operator.

22. The method according to claim 17, wherein the different plurality of fluctuation data is weighted, combined and synthesized, and wherein the weighted, combined and synthesized fluctuation data are changed based on a musical category or a musical factor of the part sounds, or from selection by an operator.

23. The method according to claim 17, wherein the fluctuation data is added to the period and amplitude of the generated part sounds.

24. The method according to claim 17, wherein said step of generating further includes outputting four fluctuation data for each generated part sound.

25. The method according to claim 17, wherein said step of generating fluctuation data further includes storing said part sounds and musical factors of said parts sounds in an assignment memory, and applying weighting factors to said plurality of fluctuation data, wherein said weighting factors are generated from a conversion table based on at least one of said musical factors that are received from said assignment memory.

26. The method according to claim 25, wherein said step of generating fluctuation data further includes multiplying the generated fluctuation data by said weighting factors, wherein an output therefrom are a weighted plurality of fluctuation data that is thereafter added to said plurality of part sounds in said adding step.

27. A computer program product comprising a computer-readable medium having computer program logic stored thereon for enabling a processor to add fluctuation, the computer program logic comprising:

generating sound data of a plurality of part sounds of an original tone;

generating a plurality of fluctuation data, wherein each fluctuation data of said plurality of fluctuation data is different from each other, and wherein said plurality of fluctuation data is generated for each of the plurality of generated part sounds;

adding the generated fluctuation data to each of the generated part sounds, wherein a plurality of different fluctuations are added to each of the plurality of part sounds;

synthesizing the sounds resulting from the addition of different plurality of fluctuations to each of the plurality of part sounds; and outputting the synthesized sounds as a single sound that is a modification of the original tone.

28. The computer program product according to claim 27, wherein the part sounds are simultaneously generated by a single sound instruction, each of the part sounds having a corresponding formant, frequency spectrum, frequency component or time part.

29. The computer program product according to claim 27, wherein the fluctuation data is selected from a larger plurality of fluctuation data, and changed based on a musical category or musical factor of the part sounds, or from selection by an operator.

30. The computer program product according to claim 27, wherein the fluctuation data is generated based on being filtered through a plurality of digital filters, each filter having different filter characteristics, and wherein the filter characteristics are changed based on a musical category or a musical factor of the part sounds, or from selection by an operator.

31. The computer program product according to claim 27, wherein the different plurality of fluctuation data is weighted, combined and synthesized, and wherein the weighted, combined and synthesized fluctuation data are changed based on a musical category or a musical factor of the part sounds, or from selection by an operator.

32. The computer program product according to claim 27, wherein the fluctuation data is added to the period and amplitude of the generated part sounds.

33. The computer program product according to claim 27, wherein the different plurality of fluctuation data is weighted, combined or synthesized, and wherein the combination or the ratio of the weighting, or the synthesizing is changed based on a musical category or a musical factor of the part sounds, or from selection by an operator.

34. The computer program product according to claim 27, wherein the fluctuation data is added to the period or the amplitude of the generated part sounds.

35. The computer program product of claim 27, wherein said step of generating fluctuation data further includes outputting four fluctuation data for each generated part sound.

36. The computer program product of claim 27, wherein said step of generating fluctuation data further includes storing said part sounds and musical factors of said parts sounds in an assignment memory, and applying weighting factors to said plurality of fluctuation data, wherein said weighting factors are generated from a conversion table based on at least one of said musical factors that are received from said assignment memory.

37. The computer program product of claim 36, wherein said step of generating fluctuation data further includes multiplying the generated fluctuation data by said weighting factors, wherein an output therefrom are a weighted plurality of fluctuation data that is thereafter added to said plurality of part sounds in said adding step.

* * * * *